US008225824B2

(12) United States Patent
Eliuk et al.

(10) Patent No.: US 8,225,824 B2
(45) Date of Patent: Jul. 24, 2012

(54) METHOD AND APPARATUS FOR AUTOMATED FLUID TRANSFER OPERATIONS

(75) Inventors: Walter W. Eliuk, Winnipeg (CA); Ronald H. Rob, Dugald (CA); Dustin Deck, St. Andrews (CA); Richard L. Jones, Winnipeg (CA); Thom Doherty, Winnipeg (CA)

(73) Assignee: Intelligent Hospital Systems, Ltd., Winnipeg (CA)

( * ) Notice: Subject to any disclaimer, the term of this patent is extended or adjusted under 35 U.S.C. 154(b) by 623 days.

(21) Appl. No.: 12/271,828

(22) Filed: Nov. 14, 2008

(65) Prior Publication Data

US 2009/0126825 A1 May 21, 2009

Related U.S. Application Data

(60) Provisional application No. 60/988,660, filed on Nov. 16, 2007.

(51) Int. Cl.
*B65B 1/30* (2006.01)

(52) U.S. Cl. ..... 141/192; 141/5; 141/27; 141/94; 141/330

(58) Field of Classification Search ..... 141/1, 2, 141/5, 25, 27, 104, 330, 26, 94, 95, 100–103, 141/114, 192, 198, 329
See application file for complete search history.

(56) References Cited

U.S. PATENT DOCUMENTS 2,988,984 A 6/1961 Eckert et al.
3,002,387 A 10/1961 Micheletti
3,556,342 A 1/1971 Guarr
3,878,967 A 4/1975 Joslin et al.
3,880,211 A 4/1975 Gess et al.
3,935,883 A * 2/1976 Stach et al. ..... 141/27
3,965,945 A 6/1976 Ross
4,058,121 A 11/1977 Choksi et al.
4,372,464 A 2/1983 Otten
4,464,336 A 8/1984 Hiramoto
4,634,424 A 1/1987 O'Boyle
4,648,430 A 3/1987 Di Gianfilippo et al.
4,669,599 A 6/1987 Dijkmeijer et al.
4,699,186 A 10/1987 Palin et al.
4,706,207 A 11/1987 Hennessy et al.

(Continued)

FOREIGN PATENT DOCUMENTS

CA 1317262 9/1989

(Continued)

OTHER PUBLICATIONS

"Aseptic Technique Process and End-product Evaluation," Department of Pharmacy Policy, 1994, University of Kentucky Hospital, Chandler Medical Center, 4 pages.

(Continued)

*Primary Examiner* — Timothy L Maust
(74) *Attorney, Agent, or Firm* — Oblon, Spivak, McClelland, Maier & Neustadt, L.L.P.

(57) ABSTRACT

Automated system and techniques for controlling fluid transfers among medical containers such as syringes, vials and IV bag are disclosed. In one aspect, an automated method for substantially balancing a pressure within a medical container such as a vial with ambient pressure using a fluid transfer device such as a needled syringe is disclosed. In another aspect, an automated method for substantially removing a volume of air from a medical container such as an IV bag using a fast pull technique is disclosed.

15 Claims, 10 Drawing Sheets

U.S. PATENT DOCUMENTS 4,730,435 A 3/1988 Riddle et al.
4,811,764 A 3/1989 McLaughlin
4,829,524 A 5/1989 Yoshida
4,835,372 A 5/1989 Gombrich et al.
4,835,707 A 5/1989 Amano et al.
4,842,028 A 6/1989 Kaufman et al.
4,847,764 A 7/1989 Halvorson
4,861,335 A 8/1989 Reynolds
4,871,559 A 10/1989 Dunn et al.
4,878,705 A 11/1989 Arnquist
4,910,942 A 3/1990 Dunn et al.
4,918,604 A 4/1990 Baum
4,993,598 A 2/1991 Groninger
5,004,962 A 4/1991 Fonss et al.
5,020,958 A 6/1991 Tuttobene
5,034,235 A 7/1991 Dunn et al.
5,122,342 A 6/1992 McCulloch et al.
5,144,146 A 9/1992 Wekhof
5,169,642 A 12/1992 Brinker et al.
5,203,385 A 4/1993 Waber
5,208,762 A 5/1993 Charhut et al.
5,229,074 A 7/1993 Heath et al.
5,267,174 A 11/1993 Kaufman et al.
5,288,285 A 2/1994 Carter
5,309,959 A 5/1994 Shaw et al.
5,319,543 A 6/1994 Wilhelm
5,324,519 A 6/1994 Dunn et al.
5,337,919 A 8/1994 Spaulding et al.
5,339,421 A 8/1994 Housel, III
5,341,854 A 8/1994 Zezulka et al.
5,348,585 A 9/1994 Weston
5,363,885 A 11/1994 McConnell et al.
5,366,896 A 11/1994 Margrey et al.
5,411,489 A 5/1995 Pagay et al.
5,431,201 A 7/1995 Torchia et al.
5,451,528 A 9/1995 Raymoure et al.
5,479,969 A 1/1996 Hardie et al.
5,502,944 A 4/1996 Kraft et al.
5,522,512 A 6/1996 Archer et al.
5,522,804 A 6/1996 Lynn
5,533,606 A 7/1996 Yuyama
5,534,222 A 7/1996 Kelbrick et al.
5,573,042 A 11/1996 De Haen
5,597,995 A 1/1997 Williams et al.
5,611,051 A 3/1997 Pirelli
5,635,394 A 6/1997 Horn
5,660,305 A 8/1997 Lasher et al.
5,666,410 A 9/1997 McLane
5,680,858 A 10/1997 Hansen et al.
5,700,998 A 12/1997 Palti
5,713,485 A 2/1998 Liff et al.
5,713,487 A 2/1998 Coughlin
5,744,094 A 4/1998 Castberg et al.
5,768,853 A 6/1998 Bushnell et al.
5,769,086 A 6/1998 Ritchart et al.
5,786,598 A 7/1998 Clark et al.
5,797,515 A 8/1998 Liff et al.
5,798,020 A 8/1998 Coughlin
5,805,454 A 9/1998 Valerino, Sr. et al.
5,812,410 A 9/1998 Lion et al.
5,832,447 A 11/1998 Riekr et al.
5,839,836 A 11/1998 Yuyama et al.
5,848,593 A 12/1998 McGrady et al.
5,884,273 A 3/1999 Sattizahn et al.
5,884,457 A 3/1999 Ortiz et al.
5,895,019 A 4/1999 Ibarra
5,900,211 A 5/1999 Dunn et al.
5,907,493 A 5/1999 Boyer et al.
5,911,252 A 6/1999 Cassel
5,912,818 A 6/1999 McGrady et al.
5,948,360 A 9/1999 Rao et al.
5,963,641 A 10/1999 Crandall et al.
5,971,593 A 10/1999 McGrady
5,993,046 A 11/1999 McGrady et al.
6,006,946 A 12/1999 Williams et al.
6,013,918 A 1/2000 Bushnell et al.
6,037,598 A 3/2000 Cicha
6,048,086 A 4/2000 Valerino et al.
6,060,022 A 5/2000 Pang et al.
6,068,156 A 5/2000 Liff et al.
6,082,987 A 7/2000 Su et al.
6,096,561 A 8/2000 Tayi
6,108,588 A 8/2000 McGrady
6,141,412 A 10/2000 Smith et al.
6,155,485 A 12/2000 Coughlin et al.
6,161,141 A 12/2000 Dillon
6,181,979 B1 1/2001 Murakami
6,181,982 B1 1/2001 Yuyama et al.
6,200,289 B1 3/2001 Hochman et al.
6,202,004 B1 3/2001 Valerino
6,202,711 B1 * 3/2001 Martucci et al. ..... 141/94
6,202,923 B1 3/2001 Boyer et al.
6,203,535 B1 3/2001 Barney et al.
6,249,717 B1 6/2001 Nicholson et al.
6,249,774 B1 6/2001 Roden et al.
6,279,724 B1 8/2001 Davis
6,318,630 B1 11/2001 Coughlin et al.
6,343,690 B1 2/2002 Britton et al.
6,355,024 B1 3/2002 Small et al.
6,360,794 B1 3/2002 Turner
6,370,841 B1 4/2002 Chudy et al.
RE37,829 E 9/2002 Charhut et al.
6,461,568 B1 10/2002 Eckhardt
6,470,234 B1 10/2002 McGrady
6,477,442 B1 11/2002 Valerino
6,564,121 B1 5/2003 Wallace et al.
6,566,659 B1 5/2003 Clark et al.
6,592,816 B1 7/2003 Ebel et al.
6,599,476 B1 7/2003 Watson et al.
6,604,903 B2 8/2003 Osborne et al.
6,616,771 B2 9/2003 Osborne et al.
6,623,455 B2 9/2003 Small et al.
6,673,048 B1 1/2004 Duchon et al.
6,722,404 B2 4/2004 Osborne
6,735,497 B2 5/2004 Wallace et al.
6,832,844 B2 12/2004 Guzorek
6,847,861 B2 1/2005 Lunak et al.
6,877,530 B2 4/2005 Osborne et al.
6,883,681 B1 4/2005 Coughlin et al.
6,915,823 B2 7/2005 Osborne et al.
6,975,924 B2 12/2005 Kircher et al.
6,976,349 B2 12/2005 Baldwin et al.
6,985,870 B2 1/2006 Martucci et al.
6,986,234 B2 1/2006 Liedtke
6,991,002 B2 1/2006 Osborne et al.
7,007,443 B2 3/2006 Liedtke et al.
7,017,623 B2 * 3/2006 Tribble et al. ..... 141/27
7,100,792 B2 9/2006 Hunter et al.
7,108,679 B2 9/2006 Alchas
7,111,652 B2 * 9/2006 Koide et al. ..... 141/104
7,117,902 B2 10/2006 Osborne
7,260,447 B2 8/2007 Osborne et al.
7,278,813 B2 10/2007 Davis et al.
7,403,901 B1 7/2008 Carley et al.
7,610,115 B2 * 10/2009 Rob et al. ..... 700/245
7,630,788 B1 12/2009 Reese
7,783,383 B2 * 8/2010 Eliuk et al. ..... 141/1
7,900,658 B2 * 3/2011 Osborne et al. ..... 141/2
7,997,304 B2 * 8/2011 Ranalletta et al. ..... 141/25
2001/0018937 A1 9/2001 Nemoto
2002/0020459 A1 2/2002 Baldwin et al.
2002/0035412 A1 3/2002 Kircher et al.
2002/0146343 A1 10/2002 Jenkins et al.
2002/0198738 A1 12/2002 Osborne
2003/0046114 A1 3/2003 Davies et al.
2003/0097368 A1 5/2003 Tribble et al.
2003/0216831 A1 11/2003 Hart et al.
2004/0028553 A1 2/2004 Panico
2004/0034447 A1 2/2004 Vollm
2004/0099869 A1 5/2004 Gaska et al.
2004/0104243 A1 6/2004 Osborne et al.
2004/0123567 A1 7/2004 McErlean et al.
2004/0154690 A1 8/2004 Osborne et al.
2004/0193317 A1 9/2004 Lunak et al.
2004/0241041 A1 12/2004 Woodworth et al.
2004/0249498 A1 12/2004 William et al.
2004/0250842 A1 12/2004 Adams et al.

| | | | | |
|---|---|---|---|---|
| 2005/0045242 | A1 | 3/2005 | Osborne | |
| 2005/0133729 | A1 | 6/2005 | Woodworth et al. | |
| 2005/0224137 | A1 | 10/2005 | Tribble et al. | |
| 2005/0236579 | A1 | 10/2005 | Jenkins et al. | |
| 2005/0252572 | A1 | 11/2005 | Khan et al. | |
| 2005/0252574 | A1 | 11/2005 | Khan et al. | |
| 2005/0279419 | A1 | 12/2005 | Tribble et al. | |
| 2006/0136095 | A1 | 6/2006 | Rob et al. | |
| 2006/0224414 | A1 | 10/2006 | Astrup et al. | |
| 2006/0225383 | A1 | 10/2006 | Cobb et al. | |
| 2006/0259195 | A1 | 11/2006 | Eliuk et al. | |
| 2008/0114328 | A1 | 5/2008 | Doherty | |
| 2008/0199353 | A1 | 8/2008 | Mlodzinski et al. | |
| 2009/0067973 | A1 | 3/2009 | Eliuk et al. | |
| 2009/0138340 | A1 | 5/2009 | Borr et al. | |
| 2010/0017031 | A1 | 1/2010 | Rob et al. | |
| 2010/0198392 | A1* | 8/2010 | Eliuk et al. | 700/216 |
| 2010/0241270 | A1* | 9/2010 | Eliuk et al. | 700/216 |

FOREIGN PATENT DOCUMENTS

| | | |
|---|---|---|
| DE | 4314657 | 11/1994 |
| IT | 1316152 | 12/2000 |
| WO | WO 90/09776 | 9/1990 |
| WO | WO 94/04415 | 3/1994 |
| WO | WO 95/15142 | 6/1995 |
| WO | WO 97/43915 | 11/1997 |
| WO | WO 99/29412 | 6/1999 |
| WO | WO 99/29415 | 6/1999 |
| WO | WO 99/29467 | 6/1999 |
| WO | WO 00/16213 | 3/2000 |
| WO | WO 2006/069361 | 6/2006 |
| WO | WO 2006/124211 | 11/2006 |
| WO | WO 2008/058280 | 5/2008 |
| WO | WO 2008/101353 | 8/2008 |
| WO | WO 2009/033283 | 3/2009 |
| WO | WO 2009/062316 | 5/2009 |

OTHER PUBLICATIONS

"Basic Definitions and Data for Electron Beam Sterilization," by Dr. Alex Wekhof, SteriBeam Systems, GmbH, 2005.

"BD Helping all people live health lives Prefilled. Proven. Preferred. ," BD Product Literature, BD, 2000.

"Disinfection with Flash Lamps," by A. Wekhof, PDA Journal of Pharmaceutical Science & Technology, vol. 54, No. 3, May/Jun. 2000.

"Does the Engineering of the PureBright Sterilisation System Match the Pulsed Light Sterilisation Process?," by Dr. Alex Wekhof, Advanced Ultra-Fast Sterilisation from SteriBeam Systems GmbH, Kehl, Germany, http://www.steribeam.com/articles/WTPP-Rep/html.

Industrial Automated Pulsed UV Modules, Advanced Pulsed UV and Corona Systems from SteriBeam GmbH, Kehl, Germany, http://www.steribeam.com/f-scale.puv.

"Pulsed UV Disintegration (PUVD): a new sterilization mechanism for packaging and broad medical-hospital applications," by Dr. Alex Wekhof, Dipl-Phys. Franz-Josef Trompeter, Dipl.-Ing. Oliver Franken, The First International Conference on Ultraviolet Technologies, Jun. 14-16, 2001, Washington, D.C.

Robotic system for i.v. antineoplastic drug preparation: Description and preliminary evaluation under simulated conditions by Dennis D. Cote and Mark G. Torchia, American Journal of Hospital Pharmacy, vol. 46, Nov. 1989.

"Two UV-flashlamps R&D/Labor Automated System," Advanced Pulsed UV and Corona Systems From SteriBeam GmbH, Kehl, Germany, http://www.steribeam.com/xe-labor-wt.html.

Biomedical Technology Consulting, "05BTC—Cytocare: Automatic system for the preparation of cytostatic drugs," pp. 1-22 with translation; downloaded from Internet site www.tecnomedical.com on Aug. 14, 2006.

"Welcome to the Future. The Robotic IV Admixture System: The established wave of the future with real bottom line savings." Robotic IV Admixture System; Canada, 1992.

"Dose Systems." Pharmaceutical Journal; pp. 757, vol. 254, No. 6843; Jun. 3, 1995.

International Search Report and Written Opinion, PCT/CA2008/001613 dated Sep. 12, 2008, 10 pages.

International Search Report and Written Opinion, PCT/US06/15731 dated Jul. 29, 2008, 10 pages.

International Search Report and Written Opinion, PCT/US07/84332 dated Jul. 1, 2008, 11 pages.

International Search Report and Written Opinion, PCT/US2005/046978 dated Aug. 2, 2006, 16 pages.

International Search Report and Written Opinion, PCT/CA2008/002027 dated Feb. 25, 2009, 12 pages.

Definition of "cannulal", Webster's Third New International Dictionary, Unabridged. Copyright 1993 Merriam-Webster, Incorporated.

Kohler, et al. "Standardizing the expression and nomenclature of cancer treatment regiments," Am J Health-Svst Pharm: 1998; 55: 137-144.

Office Action in Re Exam Control No. 95/000,333; mailed Mar. 7, 2008; 36 pages.

Office Action in Re Exam Control No. 95/000,333; mailed May 5, 2009; 43 pages.

Office Action in Re Exam Control No. 95/000,334; mailed Feb. 27, 2008; 17 pages.

Office Action in Re Exam Control No. 95/000,335; mailed Mar. 7, 2008; 16 pages.

Office Action in Re Exam Control No. 95/000,336; mailed Mar. 11, 2008; 36 pages.

Office Action in Re Exam Control No. 95/000,336; mailed Oct. 15, 2008; 21 pages.

Office Action in Re Exam Control No. 95/000,340; mailed Mar. 21, 2008; 41 pages.

Office Action in Re Exam Control No. 95/000,340; mailed Mar. 30, 2009; 69 pages.

Office Action in Re Exam Control No. 95/000,342; mailed Mar. 11, 2008; 18 pages.

Office Action in Re Exam Control No. 95/000,342; mailed Oct. 15, 2008; 28 pages.

Office Action in Re Exam Control No. 95/000,345; mailed Apr. 23, 2008; 32 pages.

Office Action in Re Exam Control No. 95/000,345; mailed Mar. 30, 2009; 67 pages.

Patent Owner's Response in Re Exam Control No. 95/000,333; filed Jun. 12, 2008, 11 pages.

Patent Owner's Response in Re Exam Control No. 95/000,333; filed Jun. 7, 2008, 37 pages.

Patent Owner's Response in Re Exam Control No. 95/000,333; filed Jun. 16, 2009, 16 pages.

Patent Owner's Response in Re Exam Control No. 95/000,335; filed Jun. 7, 2008, 33 pages.

Patent Owner's Response in Re Exam Control No. 95/000,336; filed Nov. 14, 2008, 35 pages.

Patent Owner's Response in Re Exam Control No. 95/000,336; filed Jun. 12, 2008, 13 pages.

Patent Owner's Response in Re Exam Control No. 95/000,336; filed Jun. 7, 2008, 43 pages.

Patent Owner's Response in Re Exam Control No. 95/000,340; filed Jun. 12, 2008, 10 pages.

Patent Owner's Response in Re Exam Control No. 95/000,340; filed May 20, 2008, 33 pages.

Patent Owner's Response in Re Exam Control No. 95/000,342; filed Jun. 7, 2008,32 pages.

Patent Owner's Response in Re Exam Control No. 95/000,342; filed Nov. 13, 2008, 14 pages.

Patent Owner's Response in Re Exam Control No. 95/000,345; filed Jun. 23, 2008, 32 pages.

Patent Owner's Response in Re Exam Control No. 95/000,345; filed Apr. 29, 2009, 8 pages.

Request for InterPartes Reexamination in Reexam Control No. 95/000,333; filed Jan. 11, 2008; 26 pages.

Request for InterPartes Reexamination in Reexam Control No. 95/000,334; filed Jan. 11, 2008; 54 pages.

Request for InterPartes Reexamination in Reexam Control No. 95/000,335; filed Jan. 11, 2008; 73 pages.

Request for InterPartes Reexamination in Reexam Control No. 95/000,336; filed Jan. 11, 2008; 97 pages.

Request for InterPartes Reexamination in Reexam Control No. 95/000,340; filed Jan. 30, 2008; 33 pages.
Request for InterPartes Reexamination in Reexam Control No. 95/000,342; filed Feb. 1, 2008; 27 pages.
Request for InterPartes Reexamination in Reexam Control No. 95/000,345; filed Feb. 11, 2008; 32 pages.
Third Party Comments on Patent Owner Response in Reexam Control No. 95/000,333; filed Jul. 7, 2008; 29 pages.
Third Party Comments on Patent Owner Response in Reexam Control No. 95/000,335; filed Jul. 7, 2008; 18 pages.
Third Party Comments on Patent Owner Response in Reexam Control No. 95/000,336; filed Dec. 15, 2008; 7 pages.
Third Party Comments on Patent Owner Response in Reexam Control No. 95/000,336; filed Jul. 7, 2008; 15 pages.
Third Party Comments on Patent Owner Response in Reexam Control No. 95/000,340; filed Jun. 19, 2008; 19 pages.
Third Party Comments on Patent Owner Response in Reexam Control No. 95/000,342; filed Dec. 15, 2008; 7 pages.
Third Party Comments on Patent Owner Response in Reexam Control No. 95/000,342; filed Jul. 7, 2008; 28 pages.
Third Party Comments on Patent Owner Response in Reexam Control No. 95/000,345; filed Jul. 23, 2008; 16 pages.
Third Party Comments on Patent Owner Response in Reexam Control No. 95/000,333; filed Jul. 16, 2009; 11 pages.
Office Action in Re Exam Control No. 95/000,345; mailed Jul. 2, 2009, 73 pages.
Office Action in Re Exam Control No. 95/000,340; mailed Jul. 20, 2009, 8 pages.
Reply to Office Action in European Application serial No. 05855521.0, filed Jan. 8, 2010, pp. 15.
EPO Extended European Search Report for EP Application No. 06751430.7 (PCT/US2006/015731), mailed Sep. 14, 2009, 7 pages.
Office Action in Re Exam Control No. 95/000,335; mailed Oct. 1, 2009 27 pages.
Re Exam Notification re Brief, Control No. 95/000,334; mailed Sep. 29, 2009 7 pages.
Re Exam Right of Appeal Notice, Control No. 95/000,333; mailed Dec. 2, 2009.
International Preliminary Report on Patentabililty, PCT/CA2008/000348, dated Sep. 3, 2009, 10 pages.
International Search Report and Written Opinion, PCT/CA2008/000348 dated Jun. 3, 2008, 10 pages.
Office Action in U.S. Appl. No. 11/316,795, notification date Dec. 29, 2008, 16 pages.
Office Action in U.S. Appl. No. 11/389,995, notification date Apr. 28, 2009, 8 pages.
Patent Owner's Entry in Reexam Control No. 95/000,333; filed Jan. 22, 2010; 32 pages.
Interview Summary in U.S. Appl. No. 11/316,795, notification date Feb. 24, 2009; 4 pages.
Reply to office action in U.S. Appl. No. 11/316,795, notification date Mar. 27, 2009; 14 pages.
Notice of Allowance in U.S. Appl. No. 11/316,795, mailing date Jun. 22, 2009; 6 pages.
Interview Summary in U.S. Appl. No. 11/389,995, notification date Jun. 17, 2009; 4 pages.
Reply to office action in U.S. Appl. No. 11/389,995, notification date Sep. 15, 2009; 14 pages.
Express Withdrawal of Appeal in Reexam control No. 95000334; filed Oct. 29, 2009; 4 pages.
Patent Owner Petition in Reexam control No. 95/000334; filed Nov. 10, 2009; 8 pages.

* cited by examiner

METHOD AND APPARATUS FOR AUTOMATED FLUID TRANSFER OPERATIONS

CROSS REFERENCE TO RELATED APPLICATIONS

This application claims priority under 35 U.S.C. §119(e) to U.S. Provisional Patent Application Ser. No. 60/988,660, entitled "Method and Apparatus for Automated Fluid Transfer Operations," and filed by Eliuk et al. on Nov. 16, 2007, the entire disclosure of which is incorporated herein by reference.

The entire disclosure of each of the following documents is incorporated by reference herein: U.S. Provisional Patent Application Ser. No. 60/971,815, entitled "Gripper Device," and filed by Eliuk et al. on Sep. 12, 2007; U.S. Provisional Patent Application Ser. No. 60/891,433, entitled "Ultraviolet Disinfection in Pharmacy Environments," and filed by Mlodzinski et al. on Feb. 23, 2007; U.S. Provisional Patent Application Ser. No. 60/865,105, entitled "Control of Needles for Fluid Transfer," and filed by Doherty et al. on Nov. 9, 2006; U.S. Provisional Application Ser. No. 60/681,405, entitled "Device and Method for Cleaning and Needle/Cap Removal in Automated Pharmacy Admixture System," and filed by Rob et al. on May 16, 2005; U.S. Provisional Application Ser. No. 60/638,776, entitled "Automated Pharmacy Admixture System," and filed on Dec. 22, 2004; U.S. patent application Ser. No. 12/209,097, entitled "Gripper Device," and filed by Eliuk et al. on Sep. 11, 2008; U.S. patent application Ser. No. 12/035,850, entitled "Ultraviolet Sanitization in Pharmacy Environments," and filed by Reinhardt et al. on Feb. 22, 2008; U.S. patent application Ser. No. 11/937,846, entitled "Control of Fluid Transfer Operations," and filed by Doherty et al. on Nov. 9, 2007; U.S. patent application Ser. No. 11/389,995, entitled "Automated Pharmacy Admixture System," and filed by Eliuk et al. on Mar. 27, 2006; and U.S. patent application Ser. No. 11/316,795, entitled "Automated Pharmacy Admixture System," and filed by Rob et al. on Dec. 22, 2005.

TECHNICAL FIELD

This document relates to automated processes for controlling fluid transfers among medicinal containers such as syringes, vials, and IV bags.

BACKGROUND

Many medications are delivered to a patient from an intravenous (IV) bag into which a quantity of a medication is introduced. Sometimes, the medication may be an admixture with a diluent. In some cases, the IV bag contains only the medication and diluent. In other cases, the IV bag may also contain a carrier or other material to be infused into the patient simultaneously with the medication. Medication can also be delivered to a patient using a syringe.

Medication is often supplied in dry (e.g., powder) form in a medication container such as a vial. A diluent liquid in a separate or diluent container or vial may be supplied for reconstituting with the medication. The resulting medication may then be delivered to a patient according to the prescription.

One function of the pharmacist is to prepare a dispensing container, such as an IV bag or a syringe, which contains a proper amount of diluent and medication according to the prescription for that patient. Some prescriptions (e.g., insulin) may be prepared to suit a large number of certain types of patients (e.g., diabetics). In such cases, a number of similar IV bags containing similar medication can be prepared in a batch, although volumes of each dose may vary, for example. Other prescriptions, such as those involving chemotherapy drugs, may call for very accurate and careful control of diluent and medication to satisfy a prescription that is tailored to the needs of an individual patient.

The preparation of a prescription in a syringe or an IV bag may involve, for example, transferring fluids, such as medication or diluent, among vials, syringes, and/or IV bags. IV bags are typically flexible, and may readily change shape as the volume of fluid they contain changes. IV bags, vials, and syringes are commercially available in a range of sizes, shapes, and designs.

SUMMARY

Automated systems and processes that relate to controlling fluid transfers among medicinal containers are described.

In one aspect, an automated method for substantially balancing a pressure within a medical container with ambient pressure is disclosed that can include a) drawing a volume of ambient air into a fluid transfer device through a conduit of the fluid transfer device. The method can also include b) inserting the conduit of the fluid transfer device having the volume of ambient air into a fluid transfer port of a medical container having a pressure that is above or below ambient pressure. The method can further include c) balancing the pressure within the medical container with a pressure within the fluid transfer device that is substantially at ambient pressure. The method can additionally include d) removing the conduit of the fluid transfer device from the fluid transfer port of the medical container. The method can also include e) balancing the pressure within the fluid transfer device with ambient pressure. The method can further include f) re-inserting the conduit of the fluid transfer device into the fluid transfer port of the medical container. The method can additionally include balancing the pressure within the medical container with the pressure within the fluid transfer device. The method can also include h) repeating steps d) to g) until the pressure within the medical container is substantially at ambient pressure.

In some implementations, the conduit can include a needle that is not a vented needle.

In some implementations, the medical container can include a vial and the fluid transfer device can include a syringe.

In some implementations, a robotic gripper device can be used to handle the syringe. The gripper device can include a pair of gripper fingers, each gripper finger can include at least one jaw that has a recess to grasp a barrel of the syringe. The recess can include at least one tapered contact surface that has a leading edge to contact the syringe barrel. The tapered contact surface can be disposed at an angle with respect to a longitudinal axis of the syringe barrel when the gripper fingers are in contact with the syringe barrel. The gripper device can also include an actuator to engage the gripper fingers to grasp the syringe barrel based on inputted or stored motion profile parameters.

In some implementations, the method can also include drawing a predetermined amount of fluid from the medical container into a fluid transfer device in a compounding area after the pressure within the medical container has been substantially balanced with ambient pressure. In some embodiments, the compounding area can be under a substantially unidirectional air flow. In some embodiments, a pressure within the compounding area can be regulated to a pressure level that is substantially below or above ambient pressure. In some embodiments, the pressure within the compounding area can be higher than a pressure within an inventory area. In some embodiments, the medical container can have a negative pressure relative to ambient pressure after the predetermined amount of fluid has been drawn from the medical into the fluid transfer device. In some embodiments, the negative pressure can be substantially created by drawing a predetermined volume of air from the medical container into a fluid transfer device.

In some implementations, the method can also include, before the predetermined amount of fluid is drawn from the medical container into the fluid transfer device, sanitizing the fluid transfer port of the medical container using a UV sanitization system. The UV sanitization system can include one or more UV radiation source to supply a dose of UV radiation. The UV sanitization system can also include a plurality of radiation seal assemblies, each radiation assembly having an aperture and configured to engage a fluid transfer port of a medical container having a particular shape. The UV sanitization system can further include an actuator to bring a fluid transfer port to be sanitized into optical communication with the radiation source through the aperture of the radiation seal assembly determined to correspond to the fluid transfer port to be sanitized.

In some implementations, the method can also include weighing the medical container or the fluid transfer device to verify that the predetermined amount of fluid has been drawn from the medical container into the fluid transfer device using a weighing system that includes an ionizer to generate ionized air to substantially mitigate static charge built-up.

In another aspect, an automated method for substantially removing a volume of air from a medical container is disclosed that can include a) inserting a conduit of a fluid transfer device into a fluid transfer port of a medical container having a volume of fluid and a volume of air. The method can also include b) performing a rapid draw such that substantially all of the air is drawn from the medical container into the fluid transfer device without drawing a substantial volume of fluid from the medical container into the fluid transfer device. The method can further include c) after an optional delay, disengaging the conduit of the fluid transfer device from the fluid transfer port of the medical container. The method can additionally include d) repeating steps a) to c) until substantially all of volume of air has been removed from the medical container.

In some implementations, the conduit can include a needle.

In some implementations, the medical container can include an IV bag and the fluid transfer device can include a syringe. In some embodiments, the method can also include compressing the IV bag to substantially prevent walls of the IV bag from adhering to one another while removing a volume of air from the IV bag.

In some implementations, a robotic gripper device can be used to handle the syringe. The gripper device can include a pair of gripper fingers, each gripper finger can include at least one jaw that has a recess to grasp a barrel of the syringe. The recess can include at least one tapered contact surface that has a leading edge to contact the syringe barrel. The tapered contact surface can be disposed at an angle with respect to a longitudinal axis of the syringe barrel when the gripper fingers are in contact with the syringe barrel. The gripper device can also include an actuator to engage the gripper fingers to grasp the syringe barrel based on inputted or stored motion profile parameters.

In some implementations, the method can also include expelling any fluid drawn into the fluid transfer device after disengagement of the conduit from the fluid transfer port.

In some implementations, the method can also include transferring a predetermined amount of fluid from the medical container into a fluid transfer device or from a fluid transfer device into the medical container in a compounding area after the desired portion of the volume of air has been removed from the medical container. In some embodiments, the compounding area can be under a substantially unidirectional flow. In some embodiments, a pressure within the compounding area can be regulated to a pressure level that is substantially below or above ambient pressure. In some embodiments, the pressure within the compounding area can be higher than a pressure within an inventory area.

In some implementations, the method can also include, before the predetermined amount of fluid is transferred from the medical container into the fluid transfer device or from the fluid transferred device into the medical container, sanitizing the fluid transfer port of the medical container using a UV sanitization system. The UV sanitization system can include one or more UV radiation source to supply a dose of UV radiation. The UV sanitization system can also include a plurality of radiation seal assemblies, each radiation seal assembly having an aperture and configured to engage a fluid transfer port of a medical container having a particular shape. The UV sanitization system can further include an actuator to bring a fluid transfer port to be sanitized into optical communication with the radiation source through the aperture of the radiation seal assembly determined to correspond to the fluid transfer port to be sanitized.

In some implementations, the method can also include weighing the medical container or the fluid transfer device to verify that the predetermined amount of fluid has been drawn from the medical container into the fluid transfer device using a weighing system that includes an ionizer to generate ionized air to substantially mitigate static charge built-up.

The details of one or more embodiments are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

This document describes systems and techniques for automated fluid transfer operations among medicinal containers such as syringes, vials, and IV bags. In various examples, the systems and techniques may be used during admixture or compounding and/or dispensing of drug doses, such as in an automated pharmacy admixture system (APAS). Examples of an APAS system are described, for example, with reference to FIGS. 1 through 5 in U.S. patent application Ser. No. 11/316,795, filed by Rob et al. on Dec. 22, 2005, and with reference to FIGS. 1 through 5 in U.S. patent application Ser. No. 11/389,995, filed by Eliuk et al. on Mar. 27, 2006, the entire disclosure of each of which is incorporated herein by reference.

Figure 1A:
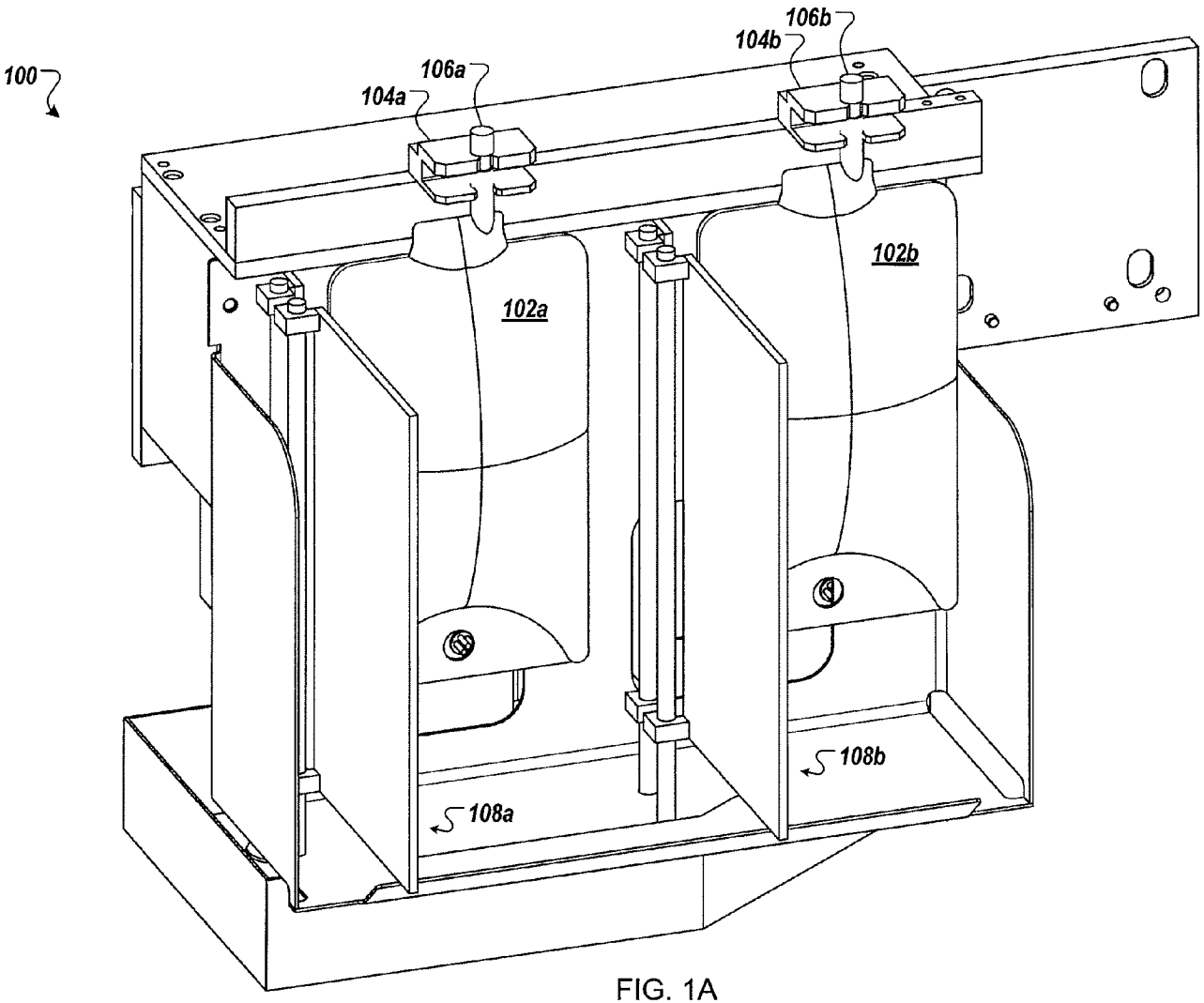
FIG. 1A show an example of a container manipulator having multiple container compressors in an open position.

FIG. 1A shows an example of a container manipulator 100 having multiple container compressors in an open position. The container manipulator 100 holds and manipulates multiple containers 102*a-b* during fluid transfer operations (e.g., while transferring fluid between an IV bag container and a syringe). The container manipulator 100 includes multiple container grippers 104*a-b* for grasping the containers 102*a-b*, respectively. In this example, the container grippers 104*a-b* grasp fluid transfer ports 106*a-b* of the containers 102*a-b*, respectively. An example of an apparatus for fluid transfer that includes a container manipulator is described with reference to FIGS. 5 through 7 of U.S. patent application Ser. No. 11/937,846, entitled "Control of Fluid Transfer Operations," and filed by Doherty et al. on Nov. 9, 2007, the entire disclosure of which is herein incorporated by reference. Exemplary container grippers that can be used in a container manipulator are described with reference to FIGS. 1 through 9 of U.S. patent application Ser. No. 12/209,097, entitled "Gripper Device," and filed by Eliuk et al. on Sep. 11, 2008, the entire disclosure of which is herein incorporated by reference.

The container manipulator 100 includes multiple container compressors 108*a-b*. The container compressors 108*a-b* compress the containers 102*a-b*, respectively, to substantially reduce or eliminate sides of the containers 102*a-b* from adhering to one another during a fluid transfer operation. In the example shown here, the container compressors 108*a-b* are in an open position and the containers 102*a-b* are uncompressed. The container compressors 108*a-b* may be placed in an open position, for example, to allow an automated hand off (e.g., as performed by a robotic arm) to load containers into or remove containers from the container manipulator 100.

Figure 1B:
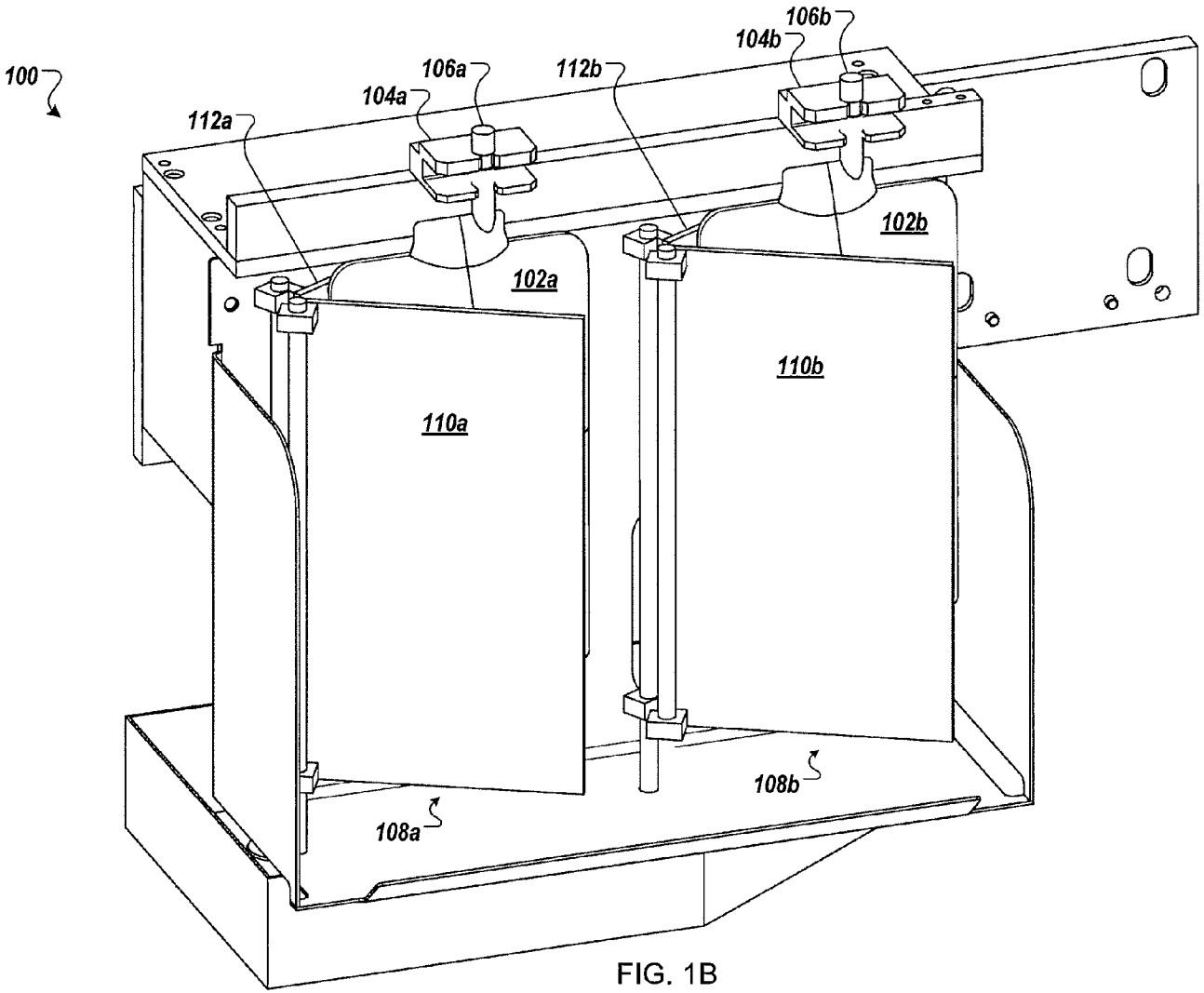
FIG. 1B show an example of a container manipulator having multiple container compressors in a closed position.

FIG. 1B shows an example of a container manipulator 100 having multiple container compressors in a closed position. In the example shown here, the container compressors 108*a-b* are in a closed position, which compresses the containers 102*a-b* prior to or during a fluid transfer operation.

For example, a needle of a fluid transfer device (e.g., a syringe needle) may be inserted in the fluid transfer port 106*a* to draw fluid from the container 102*a* (e.g., a flexible IV bag). Prior to (or during) the fluid transfer operation, the sides of the container 102*a* may collapse and/or adhere to one another. The container compressor 108*a* compresses the container 102*a* to substantially separate or maintain separation of the container's body or container walls. For example, the container 102*a* may have flexible front and back walls made of a material that can collapse and/or become adhered to itself, such as plastic. For example, plastic can include latex free plastic or polyvinyl chloride (PVC) free plastic. When drawing fluid from a container such as a flexible IV bag having fluid transfer ports (e.g., set and/or fill ports) in a port up orientation, the container can exhibit a tendency for the flexible container material to collapse.

In some implementations, collapse of the container walls can result in a condition in which fluid transfer is substantially reduced or hindered. In some implementations, the reduction or stoppage of fluid transfer to or from the container may be referred to as "fluid locking." In some implementations, a fluid lock in an automated fluid transfer system can result in an incorrect amount of fluid being transferred between a container (e.g., IV bag) and a fluid transfer device (e.g., syringe). In some implementations, fluid locking can occur during a fluid transfer operation. In some implementations, a container may be received from a container manufacturer with walls or sides of the container already collapsed and/or adhered to one another.

In various examples, the container compressor 108*a* may advantageously substantially reduce or prevent fluid lock from occurring during a fluid transfer operation and/or may substantially remove or mitigate a preexisting fluid lock. For example, compression of a flexible fluid reservoir type container (e.g., an IV bag) can distribute fluid in container throughout the container. The distribution of the fluid throughout the container can separate collapsed walls of the container.

In some implementations, the container compressors 108*a-b* accept a full range of flexible container sizes (e.g., IV bag width, length, and volume). By way of example and not limitation, the container compressors 108*a-b* can compress containers (e.g., flexible IV bags) having volumes in the range of 25 milliliters up to at least about 1 liter of fluid or more. In some implementations, the container compressors 108*a-b* can compress containers (e.g., flexible IV bags) containing from 0% to 150% of nominal fluid volume of the container.

In some implementations, the container compressors 108*a-b* can be operated by a control system to open, close, and relax compression of a container at particular times (e.g., while disengaging a needle from the fluid transfer port after a draw is complete). In some implementations, failing to relax the compression when withdrawing a needle can cause fluid leakage at the fluid transfer port.

In some implementations, the control system can be via an active control on the container compressors 108*a-b*. For example, the weight of the container can be measured and a corresponding level of compression can be applied to the container by a container compressor. In one example, compression can be measured by measuring a torque or force exerted by one or more compression plates. In one example, a strain gauge can be used between a container compressor and a container. In one example, image processing can be used to determine a level of compression of a container or if the container is fluid locked or not. In one example, a compressor plate can be controlled to a particular position to provide a particular level of compression. In some implementations, the control system can be a passive compression device released by an external device (e.g., a robot can release a spring compressor).

In some implementations, the container compressors 108*a-b* can maintain a position of the fluid transfer ports 106*a-b* within the container grippers 104*a-b*, respectively, during compression. For example, the container compressors 108*a-b* can use a passive method of maintaining the positions such as by centering an axis of rotation of the container compressors 108*a-b* around the container grippers 104*a-b*, respectively. In some implementations, the container grippers 104*a-b* actively grasp or enclose the fluid transfer ports 106*a-b*, respectively, to substantially prevent the fluid transfer ports 106*a-b* from exiting the container grippers 104*a-b* during compression.

As shown in FIG. 1B, the container compressors 108*a-b* each include front plates 110*a-b* and back plates 112*a-b*, respectively, that are hinged to the left side of the containers 102*a-b*. In some implementations, the container compressors 108*a-b* may include more or fewer plates. In some implementations, plates may be hinged at a different location relative to the containers 102*a-b* than the location shown here.

Various implementations may apply a pressure substantially evenly along an external surface of the IV bag before and/or during a fluid transfer operation. For example, in a needle-down syringe draw of fluid from the IV bag, one or more compressors may manipulate a shape of a flexible fluid reservoir to promote separation of interior walls so as to promote the extraction of fluid being drawn by the syringe.

Figure 2C:
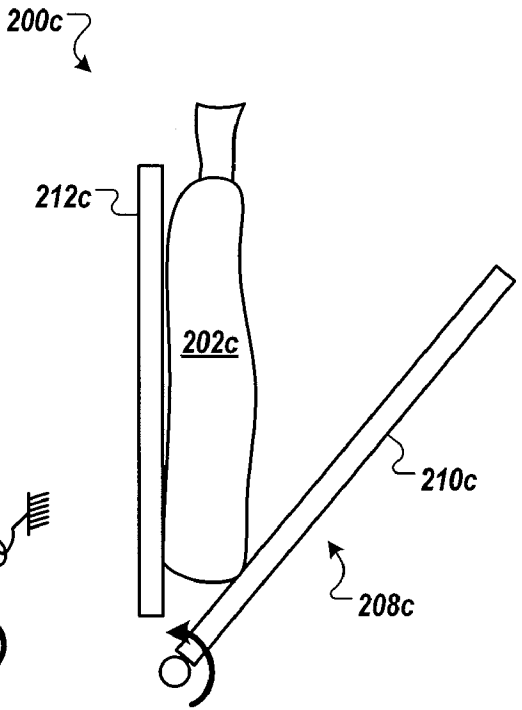
FIGS. 2A-C show three examples of multiple container manipulators each having a container compressor.
Figure 2B:
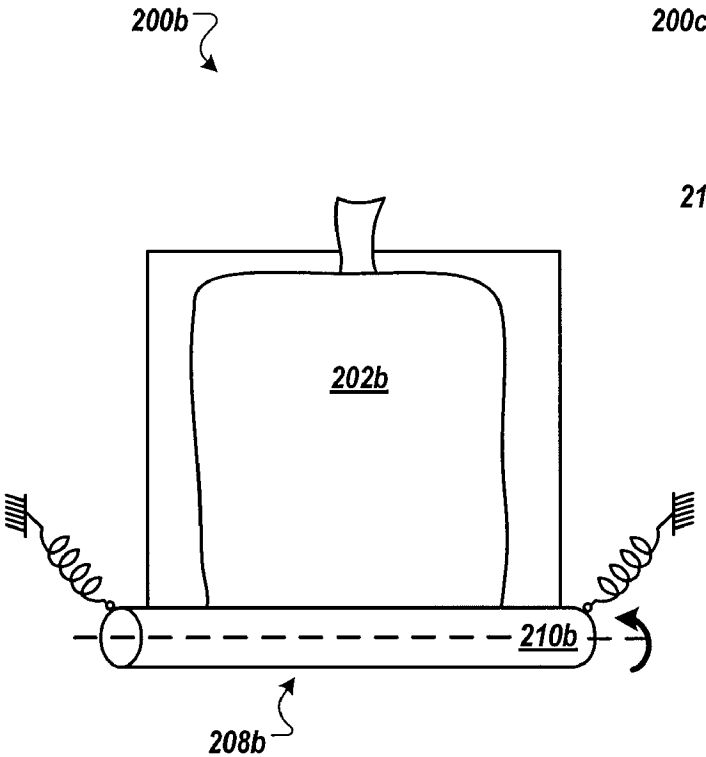
Figure 2A:
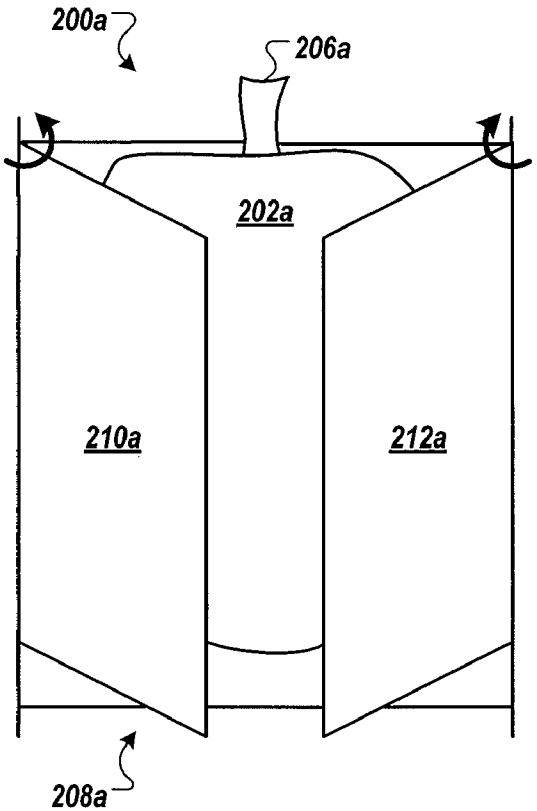

FIGS. 2A-C show exemplary container manipulators each having a container compressor. FIG. 2A shows a container manipulator 200*a* that holds a container 202*a*. The container manipulator 200*a* includes a container compressor 208*a*. The container compressor 208*a* includes compressor plates 210*a*, 212*a* hinged at the left and right sides, respectively, of the container 202*a*. In some examples, the compressor plates 210*a*, 212*a* may be separated by a small gap when compressing the container 202*a*. The compressor plates 210*a*, 212*a* may be shaped such that the gap is formed such that one end of the gap is in close proximity to the fluid transfer port 206*a* of the container 202*a*. In some examples, the gap may extend only from a region near the fluid transfer port 206*a* to a central region of the container 202*a*.

In various examples, one of the compressor plates 210*a*, 212*a* may substantially overlap the corresponding opposing plate in the closed position. In some other examples, the compressor plates 210*a*, 212*a* may have non-linear (e.g., saw-toothed, rectangular cut-outs) edges. In some implementations, a compression plate can have a curved (e.g., concave or convex) shape. When approaching a substantially closed position, some exemplary plate edges may be separated by a gap having, for example, one or more segments that feature substantially non-straight, variable width, and/or curved portions.

FIG. 2B shows a container manipulator 200*b* that holds a container 202*b*. The container manipulator 200*b* includes a container compressor 208*b*. The container compressor 208*b* includes a compressor roller 210*b* for compressing the container 202*b*. Particularly, the compressor roller 210*b* forces fluid from the bottom of the container 202*b* toward the top of the container 202*b*.

FIG. 2C shows a container manipulator 200*c* that holds a container 202*c*. The container manipulator 200*c* includes a container compressor 208*c*. The container compressor 208*c* includes a compressor plate 210*c* hinged at the bottom side of the container 202*c* for compressing the container 202*c*.

In some implementations, the container compressor 208*c* (or the other container compressors 108*a-b*, 208*a*, and 208*b*) can include a fixed back plate 212*c* on which one or more hinged compressor plates or rollers press against to compress the container 202*c*. In some implementations, a container compressor can include a spring loaded back plate on which one or more hinged plates or rollers press to compress a container. In some implementations, a container compressor can include back plates and/or rollers on which corresponding front plates and/or rollers press against for compressing a container.

Figure 3:
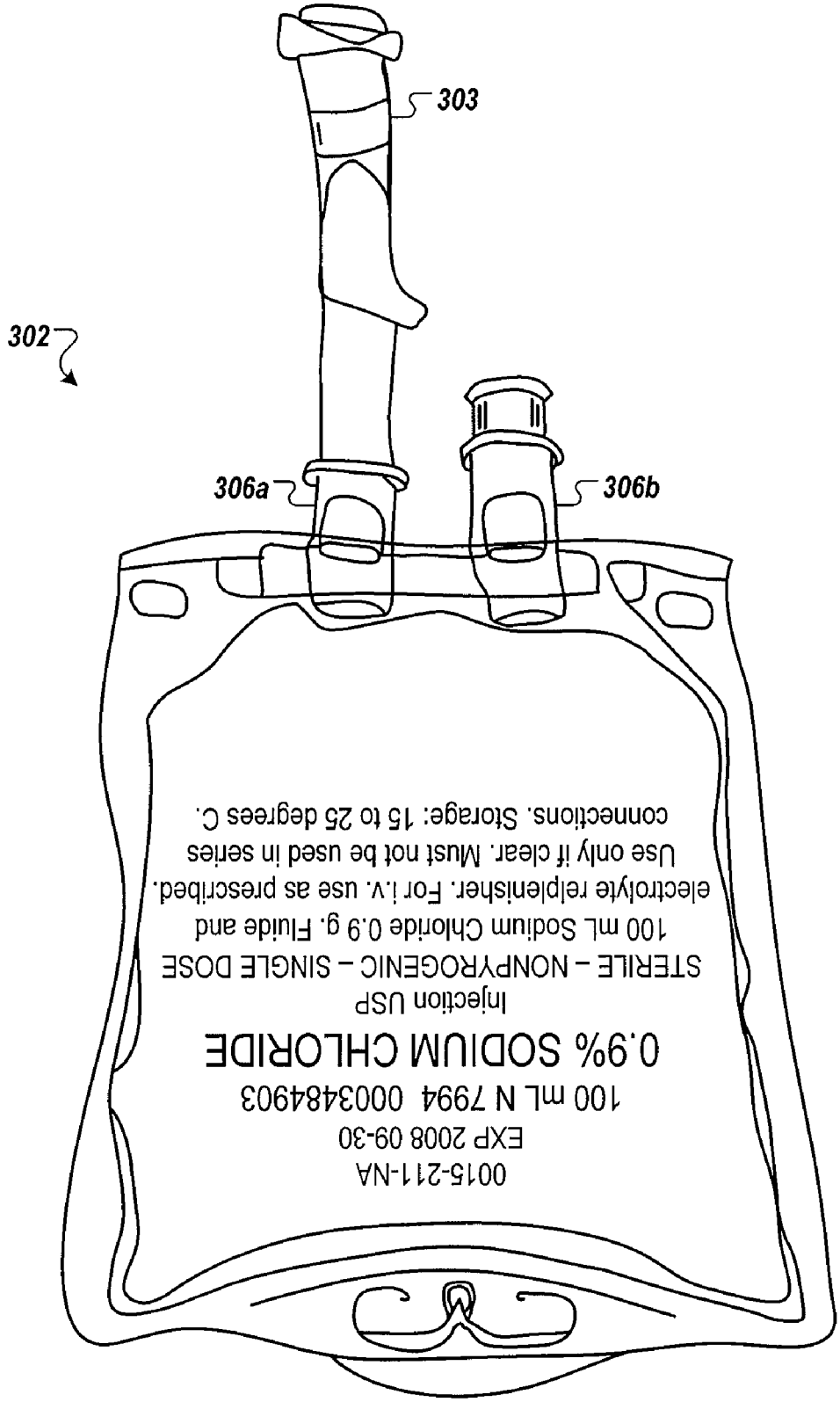
FIG. 3 shows an example of a container having a protective cover on a fluid transfer port in an uncontrolled position.

FIG. 3 shows an example of a container 302 having a protective cover 303 on a first fluid transfer port 306*a*. In this example, the protective cover 303 is in an uncontrolled position. The container 302 also includes a second fluid transfer port 306*b*. If left uncontrolled during a fluid transfer operation, the protective cover 303 could potentially contact (and possibly contaminate) a needle being used to access the second fluid transfer port 306*b*, for example.

In some implementations, a container (e.g., a flexible IV bag) can have the protective cover 303 added to the first fluid transfer port 306*a* (e.g., a set tube). In some implementations, the protective cover 303 can be an extension. In some implementations, the protective cover 303 is removed prior to performing a fluid transfer operation using the first fluid transfer port 306*a* (e.g., using the IV bag with the set).

In an automated fluid transfer system, the protective cover 303 can cause interference when left in an uncontrolled position. For example, the protective cover 303 can move in front of or on top of the second fluid transfer port 306*b*. This can substantially prevent the second fluid transfer port 306*b* from being grasped by a robotic arm or placed in a container gripper. For example, this can occur when a robotic arm retrieves the container 302 from an inventory rack or when a robotic arm transports the container 302 to a container scale, a container manipulator, or a container parking/storage location.

Figure 4:
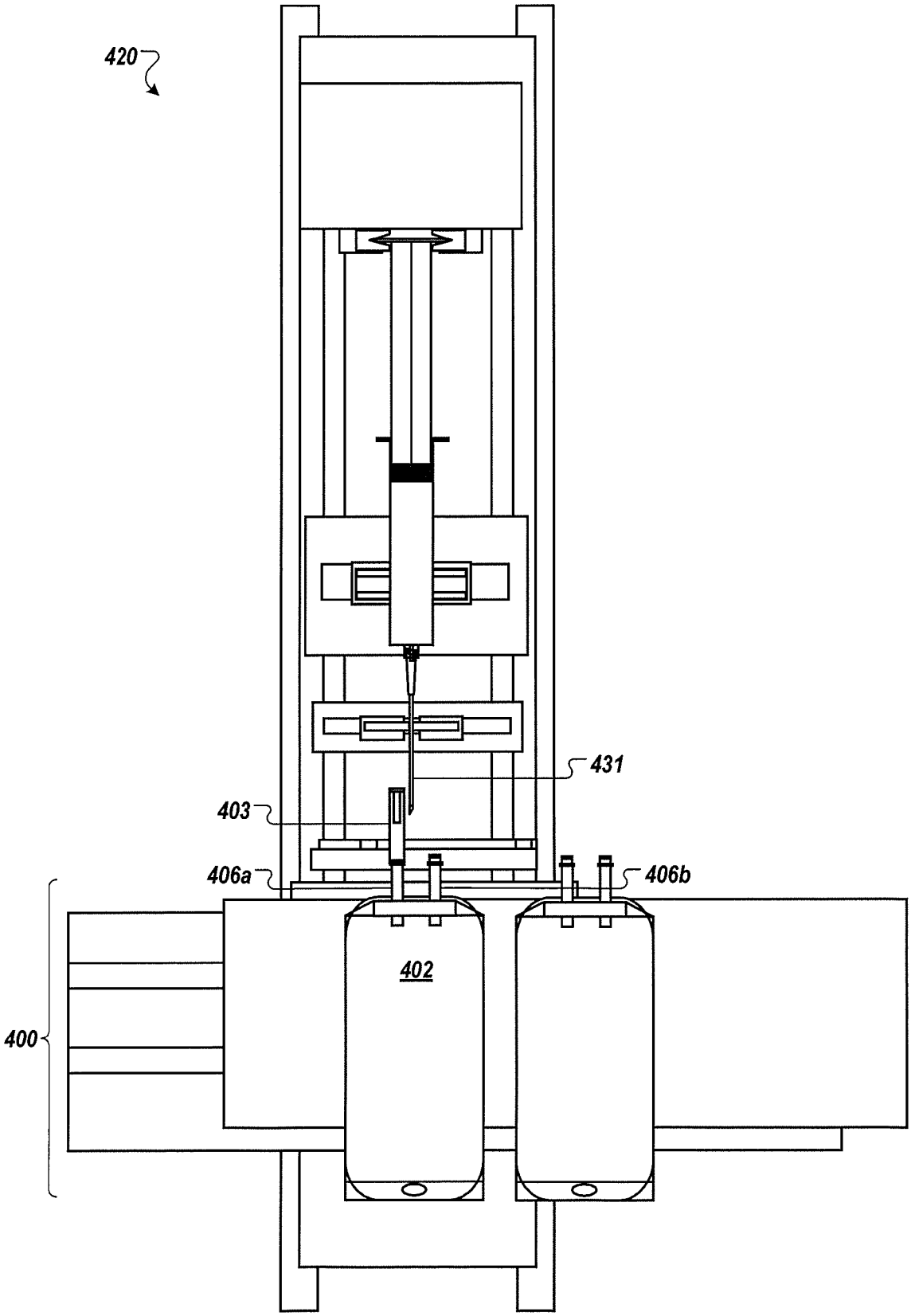
FIG. 4 shows an example of an apparatus for performing a fluid transfer operation.

FIG. 4 shows an example of an apparatus 420 for performing a fluid transfer operation. Exemplary aspects of a similar syringe manipulator apparatus are described, for example, with reference to FIG. 7 in U.S. patent application Ser. No. 11/937,846, entitled "Control of Fluid Transfer Operations," and filed by Doherty et al. on Nov. 9, 2007, the entire disclosure of which is herein incorporated by reference. In some implementations, during the fluid transfer operation a protective cover 403 in the uncontrolled position could potentially contaminate a critical surface (e.g., a needle 431), or obstruct the insertion of the needle 504 into a desired fluid port. The protective cover 403 covers a first fluid transfer port 406*a* of a container 402. The container 402 also includes a second fluid transfer port 406*b*. In one example, the fluid transfer operation is performed using the second fluid transfer port 406*b* of the container 402.

The container 402 is held by a container manipulator 400. The container manipulator 400 can move in a horizontal direction to align a particular container and fluid transfer port with the needle 431.

In one example, the protective cover 403 can contaminate a critical surface by inadvertently contacting the critical surface during positioning of the container 402 relative to the critical surface (e.g., moving the needle 431 for insertion in the second fluid transfer port 406*b* or moving the container 402 to align with the needle 431). In another example, the protective cover 403 can fold or move over top of the second fluid transfer port 406*b* during insertion of the needle 431 in the second fluid transfer port 406*b*.

In some implementations, critical surfaces can be sanitized using an ultraviolet (UV) light. An example of an automated apparatus for sanitizing portions of containers and fluid transfer devices using UV light is described with respect to FIGS. 3A-C, 4A-C, 5-7, 8A-B, 9A-B and 11A-F of U.S. patent application Ser. No. 12/035,850, entitled "Ultraviolet Sanitization in Pharmacy Environments," and filed by Reinhardt et al. on Feb. 22, 2008, the entire disclosure of which is incorporated herein by reference.

In another example of UV sanitization, an optical conduit (e.g., light pipe, optical fiber, optical waveguide) can be used, for example, to reduce transmission losses between at least one UV source and the sanitization target. In some implementations, the optical conduit allows transmission of a particular wavelength range (e.g., a UV wavelength range used for sanitization). The conduit can be placed in close proximity to the UV source such that substantially most or all of the UV light emitted by the UV source (e.g., a diffuse source) impinges on the entry plane of the conduit. In some implementations, once the UV light enters the conduit, losses within the conduit can be a function of the conduit material and construction. For example, an optical conduit may include one or more optical fibers, or one or more formed structures (e.g., glass or plastic structures). Light exiting the optical conduit may pass through one or more optical lenses. One or more convex and/or concave lenses may be selectively applied (e.g., on a rotating mechanism) to provide selective control of the beam width incident on the surface(s) to be sanitized.

In some implementations, one or more optical conduits can be arranged to gather and/or combine UV light from one or more UV sources and transmit the UV light to one or more sanitization targets concurrently or simultaneously. For example, multiple UV sources can be combined using an optical conduit to focus the UV light onto a single sanitization target. In another example, a single UV source can be split using multiple optical conduits to direct UV light at multiple sanitization targets. In another example, UV light emitted from a first optical conduit can overlap or combine with UV light emitted from a second optical conduit. In some implementations, one or more UV sources can be a light emitting diode (LED) or a Xenon flash UV source. In some implementations, a UV source may include a lens to focus UV radiation. Examples of flash UV sources are described with respect to FIGS. 26A through 29C of U.S. patent application Ser. No. 11/389,995, entitled "Automated Pharmacy Admixture System," and filed by Eliuk et al. on Mar. 27, 2006, the entire disclosure of which is herein incorporated by reference.

In some implementations, the optical conduit may include an exit plane arranged in close proximity to the target such that diffusion losses between the conduit exit plane and the sanitization target are substantially minimized. In some implementations, the conduit allows the UV source to be located substantially remotely from a sanitization target (e.g., due to packaging or mounting constraints, and/or to simplify maintenance of the UV source). In some implementations, a remotely located UV source allows maintenance to be performed on the UV source (e.g., replacing a bulb) without contaminating critical surfaces (e.g., fluid ports and needles). In some implementations, a remotely located UV source protects users from, for example, a flash from an LED or Xenon flash UV source. In some implementations, the amount of benefit from the conduit can vary depending on factors such as light conduit losses (e.g., coupling or transmission losses), sanitization target size, number of UV sources, conduit geometry, etc. In some implementations, the conduit provides an approximately 10%, 20%, 30%, 40%, 50%, 60%, 70%, 80%, 90%, or 100%, 200%, 500%, 1000% or more increase in energy striking the target for UV sources illuminating vial bungs or IV bag fluid ports through a light conduit as compared to the same sanitization target at the same distance from the same UV source without a light conduit.

Figure 5:
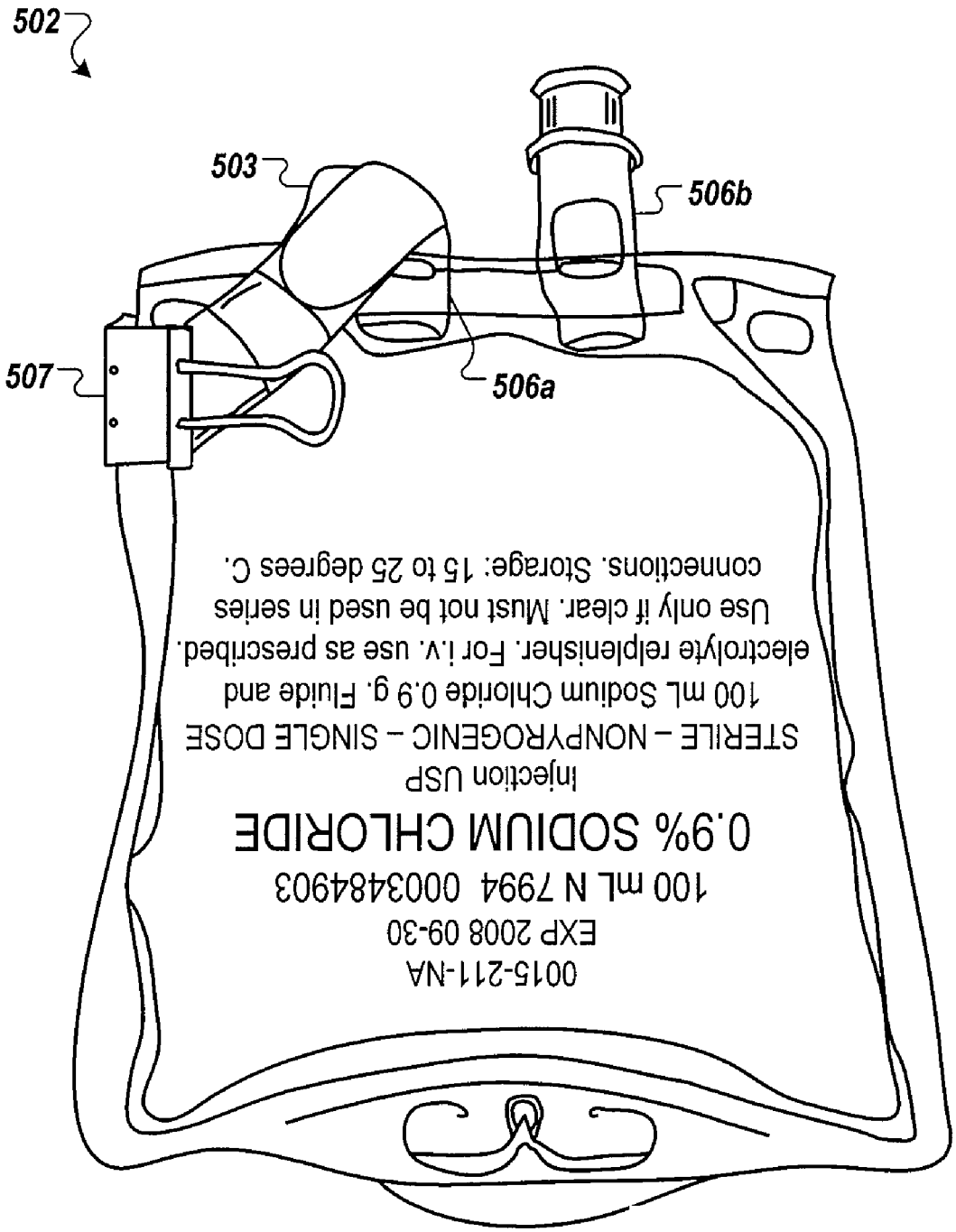
FIG. 5 shows an example of a container having a protective cover on a fluid transfer port in a controlled position.

FIG. 5 shows an example of a container 502 having a protective cover 503 on a first fluid transfer port 506*a*. The protective cover 503 is in a controlled position. The container 502 also includes a second fluid transfer port 506*b*. The controlled position of the protective cover 503 substantially prevents or eliminates contamination of critical surfaces potentially caused by contact with the protective cover 503. Particularly, the protective cover 503 is held in the controlled position by a protective cover clip 507. The protective cover clip 507 holds the protective cover 503 in a controlled position that substantially prevents or eliminates contamination of critical surfaces and/or interference due to contact with the protective cover 503.

In some implementations, the protective cover clip 507 allows a robotic arm and/or a container gripper to access the second fluid transfer port 506*b* while the protective cover 503 is in the controlled position. In some implementations, the protective cover clip 507 may be placed in a non-fluid containing region of the container 502 (e.g., the corner of an IV bag). In some implementations, the position of the protective cover 503 can be controlled using another form of restraint (e.g., a locking clasp, a screw clip, or a spring clip).

In some implementations, the container 502 (e.g., an IV bag) can contain a volume of gas (e.g., air) in addition to a volume of fluid during a fluid transfer operation. The volume of gas can be substantially removed to provide a substantially accurate fluid transfer operation. The volume of gas can vary from container to container and batch to batch.

An apparatus, such as the apparatus 420 of FIG. 4, can use a "fast pull" priming technique to substantially remove the volume of gas from a container. In various examples, priming the container involves removing substantially all the air from the container so that, in a subsequent step, fluid volume can be accurately measured by drawing the fluid into a syringe. In various implementations described herein, medical containers (e.g., IV bags) may be primed in an automated system in a manner that substantially reduces the volume of medicinal (liquid) fluid wasted, and further avoids the need to handling and disposing of such wasted fluid volumes.

In various examples, the fast pull technique may advantageously exploit a difference in flow rates of gas (e.g., air) and fluid for flows from the container to a syringe in response to a fast pullback on the syringe plunger.

Experiments were conducted with a BD 18 gauge blunt fill needle attached to a BD 60 ml syringe. Testing was performed using substantially no dwell delay time after completion of the plunger pull.

In one experiment, a 250 ml IV bag was primed with 15 ml of air. The syringe plunger was pulled back by 50 ml. The total time was measured from the start of plunger pull motion to complete disengagement. After one second, about 2 ml of fluid was drawn into the syringe. After two seconds, about 5 ml of fluid was drawn into the syringe.

In an illustrative experiment, a 60 ml syringe was first arranged to draw ambient air (not from a container) through a needle. The syringe plunger was pulled back rapidly by 60 ml in a plunger movement that lasted about 300 msec. Air pressure in the syringe was observed to equalize with ambient pressure in about 1 sec, yielding a net flow rate of about 60 ml/sec for air.

To compare the air flow rate to the flow rate of a medicinal liquid, the 60 ml syringe was next arranged to draw only fluid from an IV bag that contained substantially no air. The syringe plunger was pulled rapidly back by 60 ml in a plunger movement that lasted about 300 msec. After 2 seconds from the start of the plunger movement, the syringe needle was disengaged from the vial port. The syringe contained about 9 ml of fluid, yielding a net flow rate of about 4.5 ml/sec for fluid. Accordingly, the difference in flow rates of air to fluid is estimated in this experiment to be on the order of about 13-to-1.

When used to prime IV bags, various automated implementations may use embodiments of the fast pull technique to achieve rapid automated priming of IV bags, which may improve fluid volume accuracy of subsequent fluid draws by avoiding air bubbles that could be drawn into the syringe. Rapid IV bag priming may substantially reduce or minimize wasted fluid drawn into the priming syringe along with the air being removed from the IV bag, for example.

In various examples, the fast pull technique may include inserting a needle of a fluid transfer device (e.g., a syringe) into a fluid transfer port of a soft walled or flexible fluid reservoir (e.g., an IV bag). The reservoir may be oriented with its fluid transfer port up so that gravity causes the fluid to promote any air (e.g., headspace) to be in direct proximity to the fluid transfer port. An automated syringe manipulator system actuates to rapidly pull the syringe plunger back so as to create a vaccuum in the syringe to draw fluid (e.g., air, medicinal fluid) into the syringe.

The plunger pull motion may correspond to a predetermined volume, such as between about 5 and 100 ml, such as, for example, between about 10 and 80 ml, about 15 and 75 ml, about 20 and 65 ml, about 35 and 60 ml, or about 40 and 55 ml. As illustrative examples, the plunger pull motion may be 30 ml for a 100 ml IV bag, 50 ml for a 250 ml IV bag, 60 ml for a 500 ml IV bag, and 80 ml for a 1000 ml IV bag. Draw volume to extract all the air from an IV bag can be a function of bag size.

In general, rapid bag priming may include a plunger motion and a disengagement motion. The disengagement motion may involve, for example, removing the syringe needle from the IV bag port, thereby interrupting fluid communication of the syringe with the IV bag. In some implementations, the method may further include a computational delay time for communication among devices controlling the automated operations. Some implementations may further include a user-selectable dwell time to provide additional delay so as to promote complete air transfer from the container to the syringe. Programmable dwell times may be configured to optimize rapid transfer of an unknown volume of air without transferring a substantial amount of fluid from the flexible fluid container, as any transferred fluid may have to be expelled as waste.

The plunger motion profile may include an acceleration phase in which the plunger accelerates away from the fluid transfer port. In some examples, the plunger motion profile may further include a constant velocity phase and/or a deceleration phase. Similarly, the disengagement motion may include an acceleration, constantant velocity, and/or deceleration phases. The disengagement motion may begin during the plunger motion profile. In other embodiments, it may begin after the plunger motion profile is substantially complete. In some embodiments, a computational delay time and/or a predetermined dwell time may occur between the end of the plunger motion and the beginning of the disengagement motion.

In various examples, automated equipment may accurately perform a controlled rapid plunger pullback motion profile to a predetermined volume, such as about 30, 50, or 60 ml. The plunger pull back motion may occur in, for example, between about 100 msec and 5 seconds, such as between about 100 msec and 3 sec, about 200 msec and 2 sec, about 250 msec and 1 sec, or about 300 msec and 750 msec. In some examples, the plunger pull speed may be limited by seal integrity of the plunger, whereby excessive pull speeds may permit substantial leakage or breakage of the plunger. As motion profiles get longer, for example, more medicinal liquid may be expected to flow into the syringe, increasing wastage.

In various examples, automated equipment may perform the disengagement motion in, for example, between about 50 msec and 1 sec, such as between about 100 msec and 500 msec, 200 msec and 500 msec, or about 250 msec and about 350 msec. In some implementations, the minimum disengagement time may be practically limited, for example, to substantially reliably avoid leaving significant entrained bubbles in the IV bag. It is believed that it is beneficial to withdraw the needle slowly enough to allow sufficient time, for example, to extract any air that may be present in direct contact with the fill port.

In various examples, a computational delay time may include, for example, between about 1 msec and 1 sec for communications and control coordination among devices involved in the bag priming operation. In various examples, the computational delay time may include, for example, between about 10 and 500 msec, about 25 and 300 msec, or about 50 and 200 msec.

In some implementations, the disengagment motion may include an acceleration responsive to the detection of fluid flow into the syringe. For example, an optical sensor in optical communication with the syringe may detect the presence of fluid entering the syringe from the needle. In response to such fluid detection, the sensor may send a signal that causes a controller to initiate acceleration of the disengagement motion to substantially minimize the volume of fluid entering the syringe prior to disengagement. In another example, force applied to the syringe may be measured to detect a change in the pull force that may be associated with completion of air transfer from IV bag. In some examples, the disengagement motion may be initiated upon detection of a change in motor torque corresponding to a change in pull force, and the disengagement motion may be accelerated upon detection of fluid entry into the syringe by another sensor (e.g., acoustic, infrared, laser, photographic image monitoring).

In one example, a plunger is rapidly drawn back by a predetermined amount performed (e.g., a syringe plunger is rapidly pulled to a particular position). After a short delay (e.g., 0.05, 0.1, 0.25, 0.5, 0.75, 1, 1.25, 1.5, 1.75, 2, 3, 4, up to at least about 5 seconds) the fluid transfer device is disengaged from the container. In various examples, the length of delay may be increased for a higher resistance (e.g., longer and/or thinner) needle. For example, the delay may be adjusted according to a cross-sectional area and length of the needle or fluid conduit used for fluid transfer.

After extraction of the needle from the container, fluid drawn into the fluid transfer device may be expelled. In some embodiments, such as on syringe manipulator (needle down orientation), a waste container having suction derived from exhaust fan may assist gravity fed drip catching. Various levels of air may be in a batch of bags.

In some implementations, the rapid draw creates a large negative pressure in the fluid transfer device that draws the gas from the container. In some implementations, the short delay allows the gas to transfer from the container into the fluid transfer device. In some implementations, the short delay and a slow transfer rate of fluid versus a fast transfer rate of gas result in a substantially insignificant or negligible amount of fluid transfer during the gas removal of the fast pull technique. In some implementations, the fast pull technique substantially removes the gas from the container and a substantially insignificant or negligible amount of fluid.

In some implementations, the fast pull technique can be repeated one or more times. For example, the fast pull technique can be repeated until an expected amount of gas is removed from the container. In some implementations, the needle of the fluid transfer device can be inserted in a single aperture multiple times at a consistent orientation to substantially prevent or eliminate damage to the fluid transfer port of the container. An example of controlling needle orientation across multiple needle insertions of a vial is described with reference to FIGS. 4A-D of U.S. patent application Ser. No. 11/937,846, entitled "Control of Fluid Transfer Operations," and filed by Doherty et al. on Nov. 9, 2007, the entire disclosure of which is incorporated herein by reference.

Figure 6A:
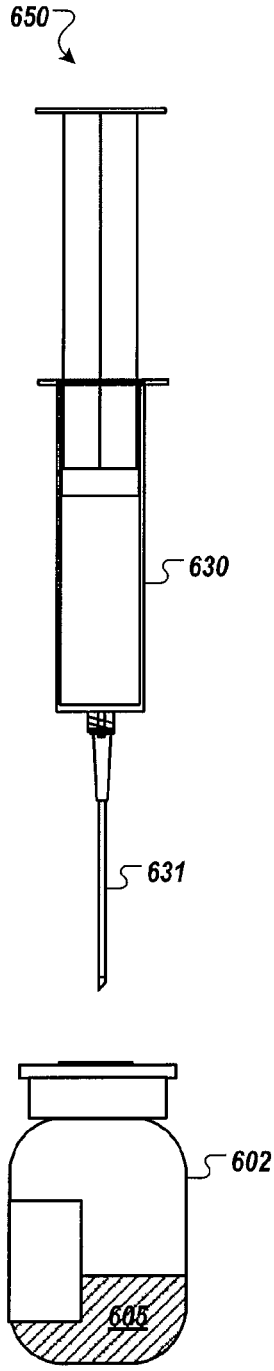
FIGS. 6A-C show examples of systems for equalizing pressure between a container and a fluid transfer device.
Figure 6B:
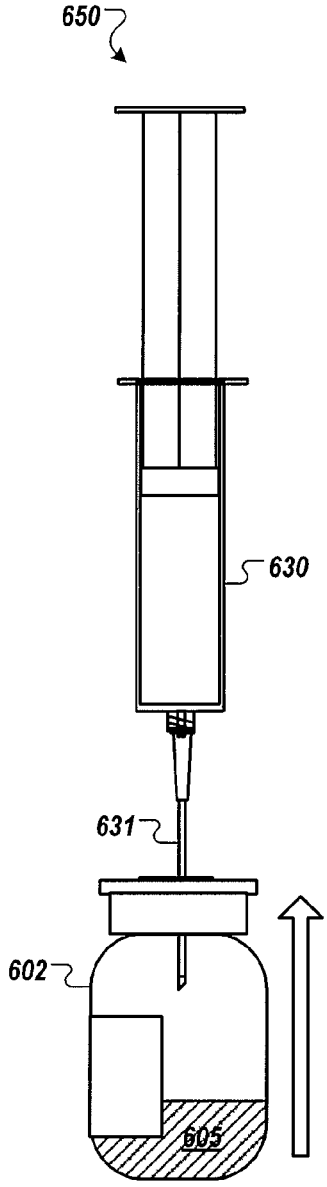
Figure 6C:
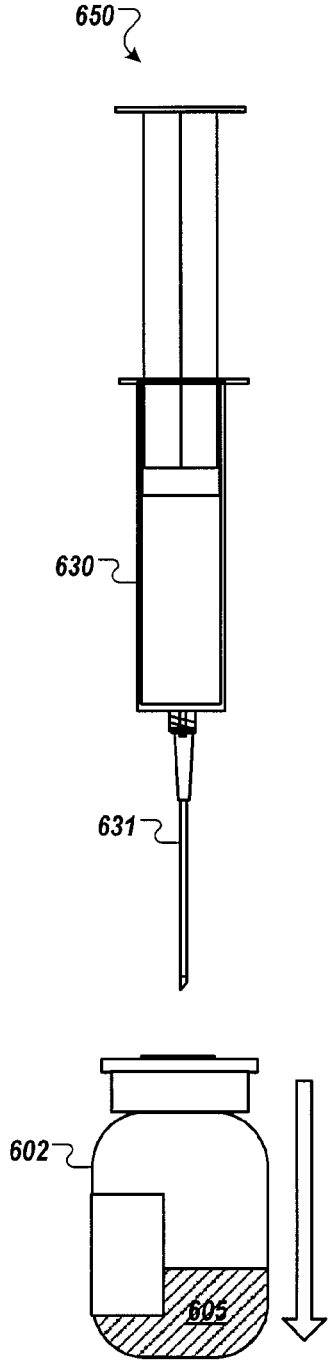

FIGS. 6A-C show an exemplary method to substantially equalize pressure between a container and a fluid transfer device. FIG. 6A shows a system 650 for equalizing pressure between a container 602 and a fluid transfer device 630. The container 602 includes a particular level of fluid as indicated by a shaded region 605. The region above the fluid is a volume of gas (e.g., air) having a particular pressure. The internal pressure in the container 602 (e.g., a vial) can vary, for example, due to variations in manufacturing, temperature, and the point of origin (e.g., the ambient pressure where the container was filled). In an illustrative example, the system 650 substantially reduces pressure imbalances between the internal pressure in the container 602 and the local ambient pressure by repeatedly balancing the internal pressure with ambient pressure with the pressure in the fluid transfer device 630.

In some implementations, an automated system can substantially equalize pressure in a container (e.g., vial, bottle) without using, for example, a vented needle. For example, an automated system can use a fluid transfer device (e.g., a syringe) and an insertion cycling technique. In this technique, a volume of gas is drawn into the fluid transfer device 630 (e.g., by actuating a plunger of a syringe) while not inserted in the container 602. In some implementations, the internal pressure in the container 602 can be at, above, or below ambient (e.g., atmospheric) pressure. In some implementations, the internal pressure in the container 602 is unknown. The volume of gas in the fluid transfer device 630 may be at an ambient pressure.

By repeatedly inserting the needle 631 of the fluid transfer device 630 into the container 602, the volume of gas in the fluid transfer device 630 can be used to reduce pressure imbalance for the pressure inside the container 602. This technique can be used to correct negative and positive container internal pressures with respect to an ambient pressure.

FIG. 6B shows the system 650 after the needle 631 of the fluid transfer device 630 has been inserted into the container 602. In the system 650 shown here, the pressures within the fluid transfer device 630 and the container 602 balance or substantially approach equilibrium. For example, if the container 602 initially had a higher pressure than the fluid transfer device 630, then the gas in the container 602 equalizes with the gas in the body region of the fluid transfer device 630 (e.g., gas flows from container into the fluid transfer device). In another example, if the container 602 initially had a lower pressure than the fluid transfer device 630, then the gas in the fluid transfer device 630 equalizes with the gas in the container 602 (e.g., gas flows from fluid transfer device into the container). In general, the internal pressures of the container 602 and the fluid transfer device 630 move toward a balance or equilibrium and toward the ambient pressure (e.g., where the fluid transfer device internal pressure is initially at ambient pressure).

FIG. 6C shows the system 650 after the needle 631 of the fluid transfer device 630 has been removed from the container 602. Here, the gas in the fluid transfer device 630 substantially balances or equalizes with the ambient pressure. In some implementations, the container 602 can include a large pressure difference relative to the ambient pressure. Correspondingly, the fluid transfer device 630 can be repeatedly inserted into the container 602, pressure balanced with the container 602, and subsequently removed from the container 602, and pressure balanced with the ambient pressure. In some implementations, the technique is repeated until the pressure in the container 602 is substantially the same as the ambient pressure.

Figure 7:
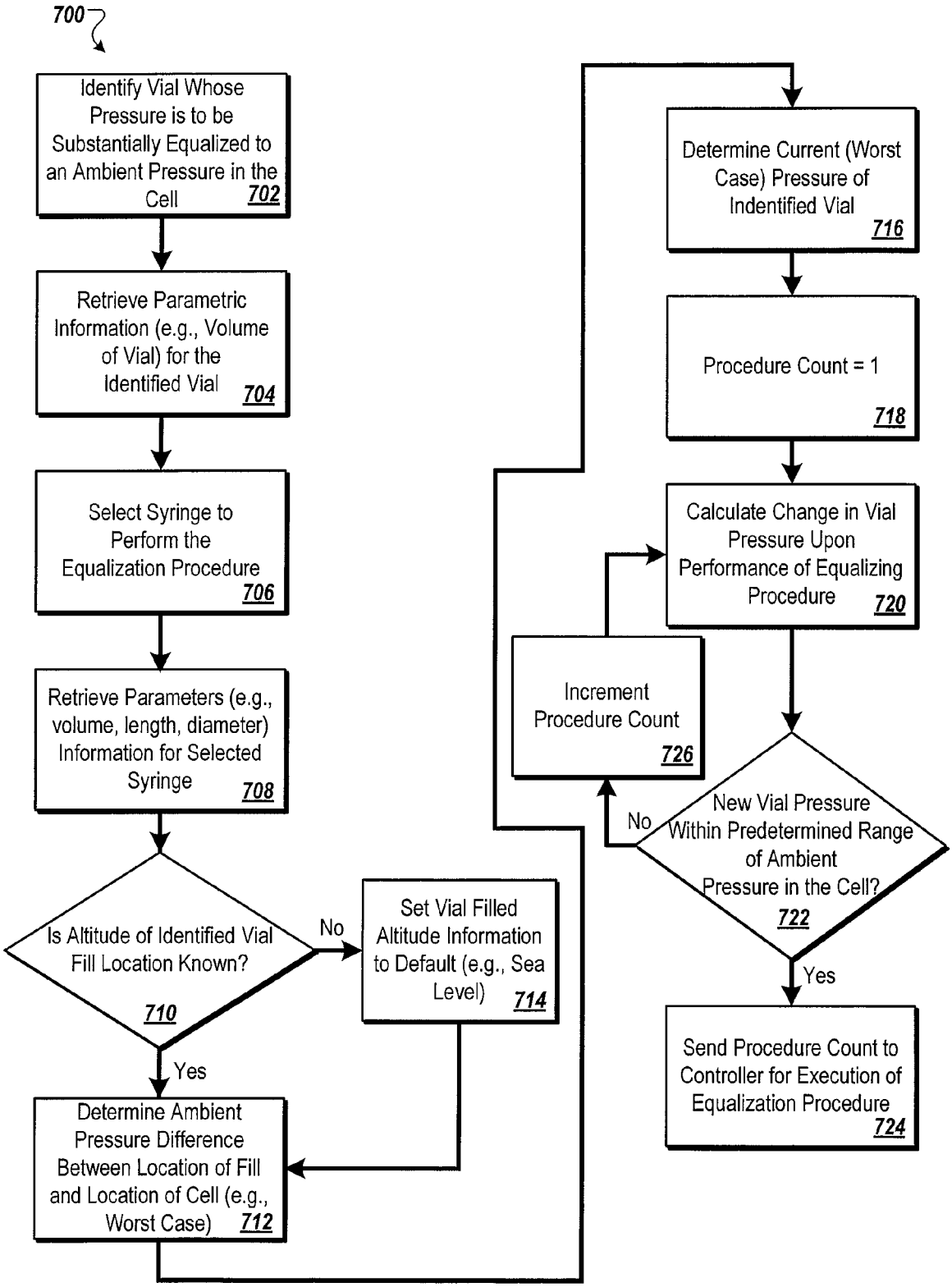
FIG. 7 is an illustrative flow chart showing an exemplary method of calculating the number of iterations that a pressure equalization procedure may need to be performed to substantially equalize a pressure within a given vial to an ambient pressure.

FIG. 7 is a flow chart that shows an exemplary method of calculating the number of iterations that the pressure equalization procedure described above may have to be performed to substantially equalize a pressure within a given vial to an ambient pressure. At step 702, an APAS system can, e.g., based on an inputted drug order, identify the vial whose pressure is to be substantially equalized to an ambient pressure within an APAS cell such as a compounding chamber of the APAS system. At step 704, the APAS system can retrieve the parameters of the vial identified that are stored in a memory of the controller. Such parameters may include the type, size, medication, manufacturer and filling location of the vial. At step 706, the APAS system can select the syringe that is to be used to equalize the pressure within the vial. At step 708, the system can retrieve the parameters of the syringe selected that are stored in the memory of the controller. Such parameters may include the type, size (e.g., length and/or diameter of the syringe barrel) and manufacturer of the syringe.

At step 710, the APAS system can check whether the parametric information retrieved for the vial may include the altitude where the vial is filled. If so, the APAS system can at step 712 determine the difference in ambient pressure between the filling location of the vial and the location at which the APAS system operates, based on the difference in altitude of these two locations. Otherwise, the APAS system can at step 714 set the altitude of the filling location to a default level (e.g., sea level) and then at step 12 use this default altitude level to calculate the ambient pressure difference between the filling location of the vial and the APAS operating location. At step 716, the APAS can evaluate the pressure within the vial based on the ambient pressure difference that is determined at step 712.

At step 718, the APAS system can initialize the count for performing the pressure equalization procedure to 1. At step 720, the APAS can calculate the change in vial pressure if the pressure equalization procedure is performed once. At step 722, the APAS system can calculate the new pressure level within the vial, based on the pressure change calculated at step 720, and then determine whether the new vial pressure is within a predetermined range of the ambient pressure of the APAS cell (e.g., about 2 psi, 1 psi, 0.5 psi, or 0.1 psi or lower above or below the ambient pressure.) If so, the APAS system send the procedure count value to a controller that controls the performance of the pressure equalization procedure. Otherwise, the APAS can increase the procedure count by 1 and then repeat steps 720 and 722 until the pressure with the vial is at a desired level.

In some implementations, an APAS system can include algorithms that are designed to allow the APAS system to operate under a range of ambient pressure including worst case conditions. The algorithms allow the APAS system to adjust for ambient pressure to ensure vial pressure is handled correctly within an acceptable range. For example, when the APAS system operates in areas with lower ambient pressure (usually at higher altitudes), the algorithms may allow the system to adjust for this lower ambient pressure so as to prevent leakage from vials upon needle engagement (e.g., while the needle is engaged during fluid transfers) and needle disengagement (e.g., after the needle has been removed from the vials). In some implementations, the algorithms may include one or more look-up tables that correlate an altitude with the number of needle insertions that may be needed to balance or equalize the pressure within a particular vial with the ambient pressure at that altitude.

In some implementations, control of vial pressure during fluid transfers with vials may cause the APAS system to split draws during reconstitution, or to pre-prime a non-reconstitution vial (draw only air from the vial initially) prior to needle engagement. The ability to adjust for ambient pressure ensures that pressure limits can be met in these situations.

In some implementations, when fluid is drawn from the container 602 into the fluid transfer device 630 using an automated apparatus (e.g., the apparatus 420 shown in FIG. 4), a negative pressure with respect to the ambient pressure can be created in the container 602 prior to a final needle extraction from the container 602. In some implementations, the negative pressure in the container 602 substantially prevents fluid leakage and aerosolization of fluid from the container 602. In some implementations, a first fluid draw from the container 602 into the fluid transfer device 630 is large enough to establish a negative pressure that remains after a final fluid draw cycle.

In some implementations (e.g., pediatric dosing), individual fluid transfer operations and/or fluid draw cycles from the container 602 can be too small to establish the negative pressure with a single dose. In this case, an automated fluid transfer apparatus can use the container pressure equalization technique described with respect to FIGS. 6A-C to create a negative pressure in the container 602 prior to a fluid transfer operation. In some implementations, this includes drawing a known or predetermined volume of gas with no fluid from the container 602 using the fluid transfer device 630 and subsequently removing the fluid transfer device 630 from the container 602. This can result in substantially removing the known or predetermined volume of gas from the container 602 resulting in a negative pressure inside the container 602 with respect to an ambient pressure.

Figure 8:
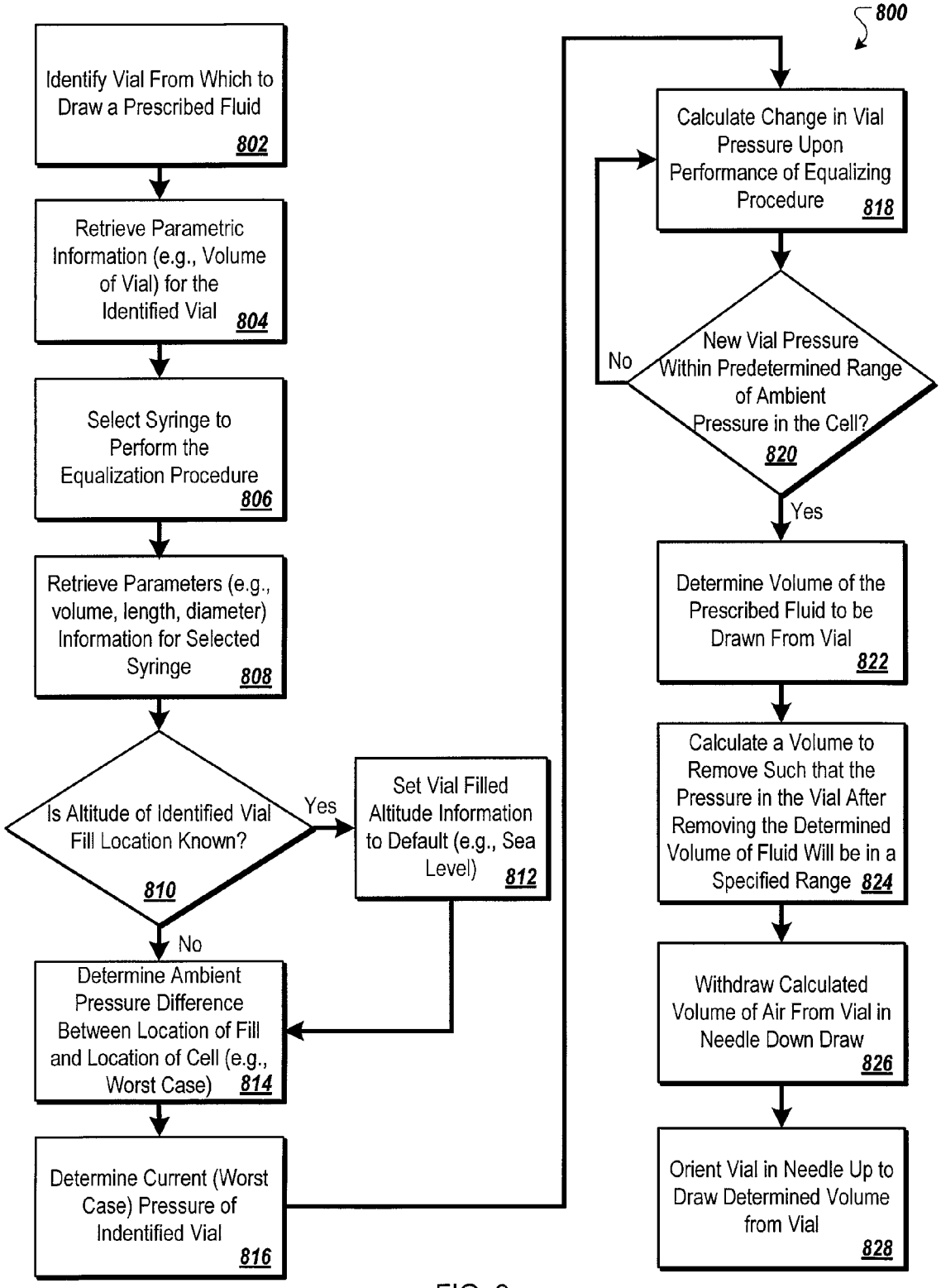
FIG. 8 is an illustrative flow chart showing an exemplary method of creating within a vial a desired negative pressure relative to an ambient pressure when a relatively small amount of fluid is to be drawn from the vial.

FIG. 8 is a flow chart that shows an exemplary method of creating within a vial a desired negative pressure relative to an ambient pressure when a relatively small amount of fluid is to be drawn from the vial. Steps 802 to 820 can be performed to substantially equalize a pressure within a vial to an ambient pressure within a APAS cell. These steps are similar to steps 702 to 722 which are described above with reference to FIG. 7. At step 822, an APAS system can, e.g., based on an inputted drug order, determine the volume of fluid that is to be drawn from a vial, At step 824, the APAS system can calculate the volume of air that needs to be removed from the vial so that, after the prescribed volume of fluid has been drawn from the vial, a negative pressure relative to an ambient pressure of an APAS cell can be created where the negative pressure is that is within a specified range of the ambient pressure. In some embodiments, the specified range can be from 0.1 to 0.99 of the ambient pressure, such as from 0.4 to 0.95, 0.5 to 0.9, 0.6 to 0.85, 0.65 to 0.8, and 0.7 to 0.9 of the ambient pressure.

At step 826, the APAS system can remove from the vial the volume of air that is calculated at step 824 using a needled syringe in a needle-down orientation. At step 828, the APAS can draw in a needle-up orientation the determined volume of fluid from the vial using the same syringe that is used in step 826 or a different syringe.

In some implementations, an automated fluid transfer between the container 602 and the fluid transfer device 630 is performed in a compounding area under a substantially laminar (e.g., smooth and/or non-turbulent) flow of gas (e.g., air). An example system for a compounding area is described with reference to fan units in FIGS. 31A through 32 of U.S. patent application Ser. No. 11/389,995, filed by Eliuk et al. on Mar. 27, 2006, the entire disclosure of which is herein incorporated by reference.

In some implementations, a membrane type material can be used as a filter or diffuser for the fan units that provide the substantially laminar flow of gas. For example, the material can be a woven fabric having small pores. In some implementations, the membrane material provides a more uniform flow of gas than a diffuser panel that includes a perforated metal sheet.

In some implementations, the membrane material substantially provides a smooth unidirectional flow of gas (e.g., a laminar flow) across the compounding area. Particularly, the membrane material can substantially provide a laminar flow of gas across areas where certain predetermined surfaces (e.g., vial bungs, bag stoppers, syringe needles) are exposed. One example of such membrane is MDP50 available from Industrial Fabrics Corporation (Minneapolis, Minn.). MDP50 is monofilament that uses polyester as fiber material. MDP50 has mesh opening of 50 microns, thread count of 305 per inch, plain weave style, thread diameter of 35 microns, open area of 34%, and air flow rating of 400-600 cfm.

Comparative testing showed that the membrane material advantageously provides substantially reduced flow perturbations downstream of the membrane. The testing compared a diffuser using a Luwa P/N 2500 membrane, commercially available from Luwa Air Engineering AG of Uster, Switzerland, and a 23% solidity (23% of the area of membrane is open) metallic diffuser. The testing included placing a test particle source (e.g., from a smoke pencil) upstream of the membrane diffuser and the metallic diffuser to determine for each of the diffusers the distance at which laminar flow occurred. The flow of gas exiting the membrane had a downward velocity of between about 30.0 to 80.0 feet per minute oriented normal to the membrane. Typical metallic diffusers can have solidifies ranging from 13% to 60%. With the same upstream conditions, the Luwa P/N 2500 membrane showed a more than ten fold reduction in eddy size and scale over the 23% solidity metallic diffuser. It was observed that substantially unidirectional flow was achieved no closer than about 6-8 inches after exiting the metallic diffuser. It was also observed that substantially unidirectional flow was achieved within substantially less than an inch after exiting the metallic diffuser.

It is believed that, in various examples, the Luwa membrane material can provide a substantially unidirectional or laminar flow within about 4.0, 3.0, 2.0, 1.0, 0.5, 0.25, 0.1 or less inches after exiting the membrane.

In some implementations, an automated fluid transfer apparatus provides a limited vertical height before critical surfaces are exposed to the flow of gas. In some implementations, the flow of gas can be unidirectional in areas where critical surfaces are exposed. In some implementations, a laminar or unidirectional flow of gas advantageously reduces deposition of contaminants on critical surfaces. For example, a contaminant particle entering a laminar or unidirectional flow of gas can have a single or limited opportunity to contact the critical surface as it passes the critical surface within the laminar flow. In another example, a contaminant particle entering a non-laminar flow (e.g., a vortex or eddy) can have multiple opportunities to contact a critical surface as the particle repeatedly re-circulates past the critical surface within the non-laminar flow.

In some implementations, the membrane material may provide improved laminar flow by generating a higher static pressure drop across itself as compared to a metallic diffuser.

About 0.01" water column for the metallic diffuser and 0.3 to 0.1" water column for the Luwa membrane were observed. It is believed that, in various implementations, the static pressure drop of the membrane material may be greater than a metallic diffuser by a factor of about 2, 5, 8, 10, 12, 15, 17, 19, and at least about 20. This may render the pressure and flow distribution above the metallic diffuser less critical with respect to providing a uniform flow downstream of the diffuser.

In some implementations, the membrane material may provide the laminar flow by having a smaller pore size than the metallic diffuser. It is believed, without limitation, that smaller pore size may break up or "chop" upstream flow perturbations into smaller pieces and therefore reduce the downstream perturbations. In some implementations, the diameters of the pores in the membrane material are in the range of about 0.002, 0.003, 0.004, 0.005, 0.006, 0.007, 0.008, 0.009 and 0.01 inches (or equivalent area for non-circular pores). In some implementations, typical metallic diffusers have pore areas equivalent to that of a circular pore diameter of about 0.06, 0.08, 0.1, 0.12, 0.14, 0.16, 0.18, and 0.2 inches.

The Luwa P/N 2500 membrane material may be made from a plastic type material, such as a woven monofilament polypropylene fabric. In addition, the base material (e.g., polypropylene) can be changed to achieve particular flow characteristics or to be compatible with various cleaning chemicals used within the automated fluid transfer apparatus. For different chemical, light (e.g., ultraviolet) environments, the membrane material could include other suitable materials, such as metallic fibers that can withstand ultraviolet light exposure without appreciable degradation.

In some implementations, the weave in the membrane can be altered to achieve particular flow characteristics. In some examples, the pore size can be changed, for example, for different static pressure conditions. The filament (e.g., fiber) size can be changed to adjust the solidity of the membrane.

Figure 9:
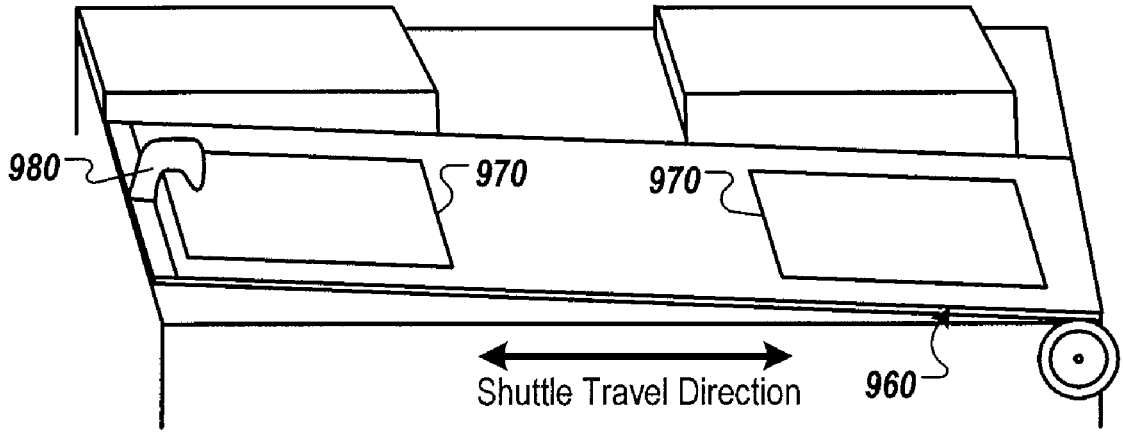
FIG. 9 shows an exemplary label shuttle that has two labels deposited on it.

In some implementations, a label pinch finger may be used in an automated pharmacy admixture system (APAS) to extract labels from a printer. Examples of printing systems are described with respect to FIGS. 37-38 of U.S. patent application Ser. No. 11/389,995, entitled "Automated Pharmacy Admixture System," and filed by Eliuk et al. on Mar. 27, 2006, the entire disclosure of which is herein incorporated by reference. For example, as shown in FIG. 9, the APAS system may include a label shuttle 960 that has one or more labels 970 deposited on it from the printer (not shown). On demand from a controller of the APAS system, the label shuttle 960 can pull away from the printer to a position within the APAS cell that is accessible for transferring labels 970 to items (not shown) that are to be labeled. The labels 970 may be self-adhering and deposited on the shuttle 960 with the adhesive side facing up.

The blank labels may come on a roll of backing paper. The labels can be die cut on the backing paper to controlled size and spacing. Sometimes the labels may not separate cleanly from the backing paper as the label shuttle pulls away with the labels on it. This may result in errors in label position on the item to be labeled and the necessity for operator intervention to clear the stuck labels.

In some implementations, the pinch finger 980 may be mounted on the label shuttle 960 and solenoid (not shown) actuated. The pinch finger 980 can push down on the adhesive face of a label 970 and hold the label 970 in position on the shuttle 960 while the shuttle 960 is pulling the label 970 from a label backing. The solenoid can then be released to retract the pinch finger 980. As a result, the label 970 becomes available to come free when the item to be labeled is pressed on to it and pulls the label 970 away with the item.

The pinch finger 980 may be so designed as to minimize the contact area of the finger 980 where it impacts the label 970, so that the finger 980 will free itself as it is retracted. This may be balanced with not making the contact pressure too high to damage the label, but yet having the finger 980 grasp with enough force to prevent slippage of the label 970 out of position.

Figure 10A:
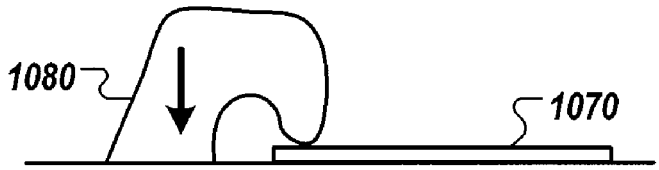
FIG. 10A shows an exemplary pinch finger grabbing a label.
Figure 10B:
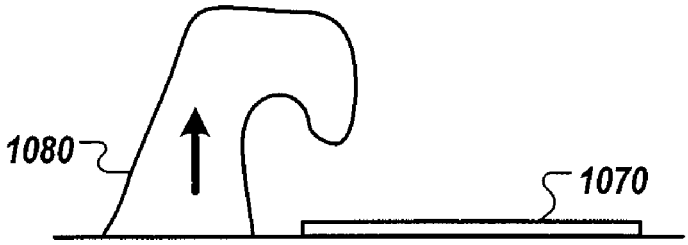
FIG. 10B shows a pinch finger released from label grip.

FIG. 10A shows a pinch finger 1080 grabbing a label 1070, while FIG. 10B shows a pinch finger 1080 released from label grip 1070.

In other implementations, more than one member may be applied to hold the label 970 on the shuttle 960. For example, two, three, four, five, or more gripping members may be arranged along an edge of the label 970 to inhibit lateral and rotational motion. In some further embodiments, one or more gripping members may be arranged along other different sides of the label for stability and to prevent, for example, curling of the label 970.

In some implementations, an APAS system may include a closed-loop control system for regulating a pressure in a compounding area and/or an inventory area of the APAS system to prevent contamination of products that are being compounded. Examples of pressure regulation in areas of an APAS system are described with respect to, for example, FIGS. 31A-32 and 40 of U.S. patent application Ser. No. 11/389,995, entitled "Automated Pharmacy Admixture System," and filed by Eliuk et al. on Mar. 27, 2006, the entire disclosure of which is herein incorporated by reference. For example, the APAS system can be operated as either a positive or a negative pressure environment within either or both of the two areas. For example, the APAS system may be operated as a negative pressure environment for hazardous drugs. The APAS system may be run either positive or negative for non-hazardous drugs.

In some implementations, Fan Filter Units (FFU's) may feed HEPA-filtered air separately into the top of both the compounding and the inventory areas. The filtered air may be fed into a ceiling-mounted plenum in both areas. The plenum may include a diffuser at its base that covers the entire ceiling area. This can cause the air to be distributed uniformly over the entire compounding and/or inventory areas.

In some implementations, air may be drawn out of the compounding area via a peripheral duct at the base of the APAS walls as well as a number of discrete points. Air may be drawn out of the compounding area to achieve uniform vertical laminar air flow within the compounding area. Air may also be drawn out of the compounding area to printer housing, waste area, and product output chute to prevent or reduce contamination in the compounding area.

In some implementations, air may be drawn out of the inventory area into a duct that traverses the center of the inventory area. In some implementations, the pressure within inventory area may be slightly negative relative to the compounding area so as to reduce potential contamination of compounding area from air from the external environment entering the loading doors and making its way into the compounding area. This may prevent flow from the inventory area to the compounding area. This may also prevent air that is drawn into the inventory area from being able to enter the compounding area.

In some implementations, the air leaving the APAS system may enter a common exhaust air plenum and then be pulled through a HEPA filter by an exhaust fan. In some implementations, the air can be expelled through a dedicated exhaust duct from the building where the APAS system is located. In some implementations, the air can be re-circulated in the room where the APAS system is housed if the system is used for compounding non-hazardous drugs.

In some implementations, the fans used in the FFU's and the exhaust fans may have variable speed. In some implementations, the FFU flow volume for the compounding area may be set at such a level that acceptable volumes of air flow can be generated through the compounding area. In some implementations, the FFU flow in the inventory area may also be set such that the inventory area can run at slightly negative pressure relative to the compounding area when the flow is balanced.

In some implementations, the FFU's can control the fan speed internally to provide a constant volume of flow as the filters load up with particulate over time and the pressure drop across them increases. In some implementations, the control computer of the APAS system may employ an algorithm that can monitor the pressure in all of the interior areas of the APAS system relative to external environment and vary the speed of the exhaust fans to maintain the pressure balance between the interior areas and the external environment. In some implementations, the control system of the APAS system may automatically compensate for any particulate that the exhaust HEPA filters may load up with during the operation of the APAS system.

In some implementations, the APAS system may include one or more mechanisms for holding a variety of IV bags at one or more stations of the APAS system. Examples of bag manipulation mechanisms are described with respect to, for example, FIGS. 6A-11 and 14-17 of U.S. patent application Ser. No. 11/389,995, entitled "Automated Pharmacy Admixture System," and filed by Eliuk et al. on Mar. 27, 2006, the entire disclosure of which is herein incorporated by reference. In some embodiments, the APAS system may include one or more passive rigid bag holding clips that have a keyhole in them. For IV bags with relatively flexible port, the bags can be forced into a friction fit in the rigid clips. In some embodiments, the APAS system may include one or more active flexible bag holding clips that can handle IV bags with a relatively rigid port. In some implementations, the active bag holding clips can spring open when bag ports are presented. The spring force of the clips may grasp the bag ports and hold the bags in place. The active clips can have a large range of compliance to handle a wide variety of IV bag ports with different shapes and/or sizes. In some implementations, the active bag holding clips can be attached to IV bag ports. The holding clips may have suitable configurations to interface with a robot arm and various operating stations such as a parking station, weighing station and mixing station. In some implementations, the active bag holding clips may include an actuator (e.g., a pneumatic or electromechanical gripper) to grasp various IV bag ports with different sizes and/or geometries. In some implementations, the bag holding clips can be fixed at locations where IV bags may need to be handed off for dosing, weighing, or parking between uses.

In some implementations, fluid transfer operations in an APAS system may be verified through weighing of syringes, vials, and/or IV bags. Examples of weight measurements in the APAS are described with respect to, for example, FIG. 3 of U.S. patent application Ser. No. 11/389,995, entitled "Automated Pharmacy Admixture System," and filed by Eliuk et al. on Mar. 27, 2006, the entire disclosure of which is herein incorporated by reference. For fluid transfers of small dose size, weighing scales having accuracy and repeatability in the 0.001 gram range may be needed to confirm the accuracy of drug weight measurements. In some cases, static charge may be built up on drug containers that are placed in proximity to covers on the scales that are not part of a weighing platform. This static charge can cause errors in the readings of the scales that may be two or three times the allowed error limits. In some implementations, an ionizer bar can be installed in the plenum over the scales. The ionizer may generate a stream of ionized air that can flow through the diffusers and down over the medical containers being weighed. The ionized air may substantially remove any excess electrostatic charge built-up from the containers. In some implementations, reduced electrostatic charge may promote more accurate weight measurement.

In some implementations, an APAS system may draw drug orders for dispensing from intermediary containers. An intermediary container can be an IV bag or a vial (empty or with diluent or with an amount of drug) into which drug and/or diluent may be pushed, for the purpose of using it as a drug source within the APAS system itself.

In some implementations, an intermediary container can be used if a drug dose volume is so small that it may be quite difficult to achieve the required accuracy within a syringe. For example, syringe dose percentage accuracy (as based on ISO 7886 syringe specification) can increase as volume increases. So a 0.3 ml draw may be less accurate (in percentage terms, not necessarily in total error volume) than a 1 ml draw. Some drug orders may require large further dilution ratios (e.g., 10:1, 100:1, 1000:1), and as such may require very small drug draws. For instance, the 100:1 case may require a 0.1 ml drug draw with a 10 ml dilution draw. Such a small drug draw can make it very difficult to achieve the accuracy required for IV preparations.

To achieve large dilution ratios and maintain required accuracy, a larger drug dose can be injected into an intermediary container and then drawn from that container. For example, to achieve the 100:1 case as described above, 1 ml drug can be injected into a 100 ml bag of diluent (which is used as a intermediary container and has a higher accuracy—about 5% compared to about 17.5% for a 0.1 ml draw into a 10 ml syringe) and then drawn 10.1 ml of the drug/diluent mixture into a syringe from the bag.

In some implementations, an intermediary container may be used to increase throughput. For example, when filling a large number of further dilution drug orders (e.g., orders that involve a draw from a drug source and then a further dilution of the drug with a draw from a diluent source), first making an intermediary container that has correct concentration and then performing straight draws from that container may provide significant throughput gains.

In a further dilution process, at least two source items (e.g., a drug source and a diluent source) are often needed for every dose. Within an APAS system, this may require the use of a robot and a needle up syringe manipulator for significant time during processing which likely reduces overall throughput. By creating the intermediary container (e.g., intermediary bags), the drug order processing can be performed solely on a needle down syringe manipulator with the robot only performing transport duties between stations. This may significantly increase overall throughput as the APAS system can perform operations on the needle up syringe manipulator and the needle down syringe manipulator concurrently.

In some embodiments, the intermediary container can be a diluent bag where any overfill may be drawn out of the bag and then the required drug amount added to the bag to achieve the desired dose concentration. IV bags typically come with some amount of overfill (e.g., a 250 ml bag may have 275 ml of fluid). The overfill of an IV bag can be removed by weighing the bag with the fluid, subtracting the known weight of the empty bag from the weight of the bag with the fluid to obtain the weight of the fluid, dividing the weight of the fluid by the density of the fluid and then drawing any excess fluid out of the bag. For example, if an APAS system weighs a 250 ml IV bag as 302 g, the weight of the empty bag is known to be 26 g, and the density of the fluid is 1 g/ml, then there is 276 ml of fluid in the bag, so 26 ml of fluid can be removed to achieve 250 ml of fluid in the bag.

In some embodiments, the intermediary container can be a diluent bag where the drug amount may be modified based on the calculated amount of overfill within the bag. For example, the same weighing exercise as described above may be performed except that rather than removing the excess fluid, more drug can be added to the IV bag to achieve the required concentration. To illustrate using the example above, instead of removing the 26 ml of fluid from the IV bag, the APAS system may increase the drug dose added into the bag by the required amount to achieve the same final concentration.

In some embodiments, the intermediary container can be an empty vial where the drug and the diluent may be added and mixed and then multiple drug orders drawn from the vial. In some embodiments, the intermediary container can be an empty bag where the drug and the diluent may be added and mixed and then multiple drug orders drawn from the bag. In some embodiments, the intermediary container can be a drug vial with some empty space in the vial to which fluid may be added to create a further diluted fluid from the original vial. For example, the vial may already have multiple full concentration drug orders drawn from it, and now has room within the vial to add fluid to achieve the dilution requirements of the remaining drug orders.

When injecting fluid into an IV bag through a fill port of the bag, there may be a tendency for the injected fluid to concentrate in or near the fill port of the IV bag and not to diffuse evenly throughout the bag. This may be problematic in several respects. For example, for drugs to be dispensed, this may create a high concentration near a dispense port of the IV bag, especially when the dispense and fill ports of the IV bag are close to each other. As a result, a higher concentration of drug may be delivered to a patient initially and then the concentration decreased over the administration of that bag. For very small doses (e.g., less than about 1 ml), most of the injected fluid can remain within the fill port of the IV bag with only a small amount of the total dose diffusing throughout the bag. For intermediary bags (including bags created for the purpose of drawing fluid therefrom, as described above), a range of concentrations may be created in the fluids drawn from the intermediary bags. Typically the first draw is of the highest concentration then the concentration lowers as the injected fluid physically mixes or diffuses throughout the bag. Consequently, a drug more or less than the desired amount may be delivered to a patient.

To achieve significantly increased mixing within an IV bag so as to provide a substantially constant concentration throughout the IV bag, several processes may be performed individually or in combination. These processes may include forceful injection, plunger cycling, air injection, and physical mixing. Examples of mixing systems are described with respect to, for example, FIGS. 51A-51B of U.S. patent application Ser. No. 11/389,995, entitled "Automated Pharmacy Admixture System," and filed by Eliuk et al. on Mar. 27, 2006, the entire disclosure of which is herein incorporated by reference.

In forceful injection, one or more manipulators of an APAS system can perform operations much harder and faster than can be achieved without automated machinery. For example, by pushing a plunger of a syringe as fast as practicable when dosing a bag, the dose may be "jetted" into the bag further than a slow push. This may promote mixing as the dose is already further into the bag than a slow push.

In plunger cycling, a plunger of a syringe can be repeatedly pulled back to its full extension or some percentage of full extension and then pushed back to the zero point. By such cycling of the plunger, fluid that is pushed into the neck of a bag can be repeatedly pushed into the body of the bag. While initial pushes might result in a higher concentration in the neck of the bag, multiple cycles of plunger pull and push may result in better mixing.

In air injection, an APAS system can inject air into an IV bag so as to create a bag with air in it. When doing physical manipulations of an IV bag (e.g., moving the bag around the APAS cell with a robot arm, performing a bag squeeze, labeling the bag, or any operations that involve physical movement of the bag), a bag with air in it, as opposed to a bag without air, may have significantly better mixing characteristics as the bag with air may better stir or splash the fluid within the bag. As a result, injection of air into an IV bag can result in better mixing being achieved during normal manipulations. Further, air injection can push the fluid that is in the neck (typically the fluid with highest concentration) into the bag, resulting in improved mixing.

In physical mixing, an IV bag can be rotated or moved rapidly up and down and/or back and forth by, e.g., a robotic arm. An IV bag can also be squeezed by, e.g., a bag squeeze system, as described above with reference to FIGS. 1A-B and 2A-C. The bag squeezes may be pulsed to further promote fluid movement within the bag. An IV bag may be massaged by, e.g., rollers at the inject neck, agitated by, e.g., beaters at the body, or spun around by, e.g., a mixer.

During normal operations, certain consumables (IV bags, syringes, vials, cap trays) may not be useable due to unforeseen errors, and some drug orders may fail their final verifications. This can be caused by properly identified failure such as damaged barcode on vials or improper barcode printed on bags. This can also be caused by incorrect operator loading such as loading the wrong syringes or IV bags. This can further be caused by in-process failures such as bevel alignment failure due to bent needle, final dosed weight failure, or output barcode read failures.

In some implementations, when a drug order fails, the drug order may be re-queued rather than failing the drug order entirely and not making it or placing the drug order into a later production queue. Re-queuing a drug order may involve placing the drug order back into the current production queue and setting the status of the drug order to be waiting on the operator to load inventory. By re-queuing of failed drug orders, all drug orders in the production queue will be completed at conclusion, and there will not be a need to run a makeup queue for the failed orders.

In some implementations, the APAS system can recognize that an item or items that are required to complete the current drug orders are no longer available in inventory and then signal the operator to load the required inventory. The APAS system may continue to process other drug orders that have available inventory while waiting for the operator to respond to the request for loading of inventory. The APAS system may also continue to process other drug orders while the operator is loading the inventory required. In some implementations, the APAS system may provide the operator a stocking list to retrieve the stock required for the system to complete the drug orders.

In some implementations, more consumables than necessary may be loaded at the beginning of a production queue. This may enable an APAS system to automatically reallocate spare consumables to in-process drug orders without any operator intervention when failures occur. In some implementations, the APAS system can suggest spare allocations based on historical performance. For example, if past processing indicates that about 5% of syringes may fail bevel alignment, the system can suggest a buffer of about 10%. In some implementations, operators can pick the spare level at which they would like to process drug orders.

An APAS system may include a secondary audit software. Secondary audit software may be a software (either a part of main software or an entirely different executable) that can perform an audit of the steps taken to prepare each dose so as to ensure that the correct dose has been prepared when compared to the original drug order. In some implementations, the APAS system can automatically run the secondary audit software before the system dispenses a drug order (real time checking). In some implementations, an operator can run the secondary audit software at a remote user station to do a secondary check of an item or entire production queue. Examples of software for order review are described with respect to, for example, FIG. 44 of U.S. patent application Ser. No. 11/389,995, entitled "Automated Pharmacy Admixture System," and filed by Eliuk et al. on Mar. 27, 2006, the entire disclosure of which is herein incorporated by reference.

In some implementations, the main software of the APAS system can, during normal processing, log multiple data points at various stages of processing. This log may contain a history of all fluid transfers that have been performed, with information about which item the fluid transfer has come from, which item the fluid has been transferred to and how much fluid has been transferred. For example, the log may contain the information that 10 ml of fluid has been transferred from a 100 ml Cefazolin vial into a 20 ml BD syringe.

In some implementations, it can be externally verified (by, for example, software engineers) that the main software can only write these log entries in the spot where actuation of fluid transfer takes place within the main code. Therefore, by checking the log entries, one may determine if a dose has been prepared correctly or not.

In some implementations, the secondary audit software can be used to recursively traverse fluid transfer history logs so as to re-create all fluid transfers and items that have been used to fill a dispensed drug order and then to use these re-created fluid transfers and items to verify that the dispensed drug order is the correct drug order as defined in the original drug order input. For example, the secondary audit software can verify that the dispensed dose has the correct concentration and volume, that there is no cross contamination generated during processing, and that the output container is the correct item.

In some implementations, the secondary audit software may not reuse any of the code that is used to generate the fluid transfers in the first place and may be coded by an individual that is different than the one who codes the program to create the fluid transfers. The use of a separate software (without reuse of the code for generating fluid transfers) to ensure that a drug order is made correctly can greatly reduce the chances that bugs/errors in the fluid transfer code may result in a bad dose, as compared to the case where the same code is used for both creating and verifying fluid transfers.

In some implementations, an APAS system may include a reject racks to output products that have failed internal verification. Representative examples of failed products may include a new, unaltered drug vial that has wrong vial ID or improper vial weight; a new, unaltered IV bag that has wrong bag ID or improper bag initial weight; a reconstituted vial that has improper vial post reconstitution weight; a dosed syringe or dosed bag that has failed in weight verification; and a dosed syringe or dosed bag that has failed in product label verification. The reject rack is separate from a product output chute for outputting normal verified products. The use of a separate reject rack allows failed products to be saved while not mixed with normal verified products. Examples of inventory racks are described with respect to, for example, FIGS. 2, 5, and 12-14 of U.S. patent application Ser. No. 11/389,995, entitled "Automated Pharmacy Admixture System," and filed by Eliuk et al. on Mar. 27, 2006, the entire disclosure of which is herein incorporated by reference.

In some implementations, the reject rack can be installed in one or more inventory carousels that may be accessed through external loading doors housed in substantially aseptic vestibules. In some implementations, the external loading doors can be used to provide access to the reject rack during compounding operations. For example, if the vestibules are maintained as an ISO Class 5 or higher clean zone and the compounding area is controlled as an ISO Class 5 clean zone, the external loading doors may be opened during compounding operations to access the reject rack. Examples of a clean zone outside the APAS cell are described with respect to, for example, FIG. 40 of U.S. patent application Ser. No. 11/389,995, entitled "Automated Pharmacy Admixture System," and filed by Eliuk et al. on Mar. 27, 2006, the entire disclosure of which is herein incorporated by reference.

In some implementations, the APAS system may prompt an user to remove the rejected products in the reject rack after a predetermined quantity has been accumulated within the rack. The APAS system may pause for operator intervention if the system determines that a reject space is unavailable due to unprocessed failed product that still occupies the reject rack position.

In some implementations, the APAS system may include a plurality of reject racks. The reject racks can have different rack configurations suitable for varying needs of particular APAS systems.

In some implementations, the APAS system may, at the time of failure, label an item to identify it as a rejected item and to provide useful information. The APAS system can also log all information on a rejected item for use in follow-up assessments.

In some implementations, the APAS system may include a product output chute for outputting finished products. Examples of product output chutes are described with respect to FIGS. 35-36 of U.S. patent application Ser. No. 11/389,995, entitled "Automated Pharmacy Admixture System," and filed by Eliuk et al. on Mar. 27, 2006, the entire disclosure of which is herein incorporated by reference. The product output chute can have an inner door and an outer door. During operation, the inner door opens first to accept an output product (e.g., a labelled and capped syringe, or a labelled bag). The inner door then closes, and the outer door opens to dispense the product. The outer door then closes again prior to opening the inner door to output more products. This ensures that finished products can be outputted during run time without compromising the compounding area environment.

In some implementations, there may exist a large range of output product sizes. For example, individual syringes can be at any state of fill, e.g., from 10% capacity to 100% capacity, with an associated wide variety of plunger draw lengths. IV bag plastic can be sticky coupled with some metals and other plastics. Both bags and syringes may be labelled, and imperfectly wrapped or the labels applied can present sticky edges that may adhere to the insides of the product output chute, especially since a product may impact when dropped onto the chute and may stop moving on its path out of the system to wait for the inner door to close and/or the outer door to open.

In some implementations, the product output chute may have multiple syringe sections and/or multiple bag sections to cover the full range of products that the APAS system can output. All sections of the output chute can employ moving features to get products moving when the outer door opens. In some implementations, the output chute has two separate syringe sections and one bag section.

If the outer door is closed upon an output syringe that may be stuck within the door closing envelope, the closing force of the outer door can damage or compromise the product. In some implementations, the APAS system can include a curtain-style sensor to monitor the area of the outer door and count the products that pass through the outer door area. For example, if a product drops quickly through the sensor curtain, the sensor output may be latched to be read or checked by software, and subsequently cleared and re-checked to be sure the sensor output has been cleared. If the sensor output has not been cleared, an object may still be in the field of the sensor, and the system may prompt an operator to intervene to clear the sensor output and resume the output process. If the output is never tripped, a product may be stuck in the product output chute, and the system may request operator intervention to clear and resume. In some implementations, the output sensor can detect if product output bin(s) have not been emptied and/or products have been piling up under the output chute, and then prompt an operator to intervene.

In some implementations, the APAS system can include a sensor to monitor the field of the inner door so as to prevent closing on a product that is stuck at the inner door area. In some implementations, the APAS can include a sensor to monitor the height of a product in the collection bin(s) below the output chute. In some implementations, the APAS system can include partial outer door cycling to automatically free stuck products. In some implementations, the APAS system can include an RFID to monitor the passage of products. In some implementations, the APAS system can include a sensor to monitor the area of interface to an optional bagger so as to ensure proper pass-off of products. In some implementations, the APAS system can operate the doors in soft mode to gently close on products to avoid damage or to free the products.

In some implementations, an APAS system, during compounding operations, can perform various verifications of the compounding process and the compounding environment. For certain classes of errors or exceptions incurred, the APAS system can autonomously handle these errors and perform corrective actions. For other classes of errors or exceptions, the APAS can request the intervention of system operator, system maintenance personnel, and/or hospital pharmacy administration.

The APAS system can includes several means to alert the need for intervention. For example, the APAS may include one or more speakers that produce audible tone(s) or voice annunciation(s). The APAS may also include one or more operator touch screens that can display visual warnings or annunciations. The APAS may further include one or more flashing amber "Operator Alert" lights. The APAS may additionally include email, text or pager notification to hospital users. The notification can target fixed computers or mobile devices including cell phones, smart phones, pagers and the like. In some implementations, the alert messages sent can provide information on severity or class of the problem, including the time and/or urgency.

In some implementations, an APAS system may verify various steps in drug preparation processes by weight measurements. For example, fluid transfers can be confirmed by measured weights. The APAS system can include one or more scales to measure weight. The scales may have internal calibration capability. For example, the scales can apply internal calibration weights to verify scale factors for the current state of the scales, including ambient and internal temperatures, aging, and minor shifts in leveling. The APAS system can periodically perform this internal adjustment based on time, run time, scale internal temperature changes, and the like. This can be initiated by either the scales or the system.

In addition to the internal scale adjustment operation, a periodic calibration check with external weights can be performed. This check can be initiated manually or automatically by the APAS system. This check can be performed manually by an operator or a maintenance personnel, or automatically by the APAS system, using a robot arm to place the weights on the scales. Compared to the internal adjustment, the external calibration can be performed using the load points actually used by weighted products. The external calibration can also be performed in the system environment, including environmentals (e.g., air flow, vibration etc.). This may give confidence regarding operating stability. Further, during external calibration, the scales can be exercised over a full representative range of operations. The combination of internal adjustment and external calibration may ensure reliable, accurate weighing in the APAS system.

A number of embodiments have been described. Nevertheless, it will be understood that various modifications may be made without departing from the spirit and scope. For example, advantageous results may be achieved if the steps of the disclosed techniques were performed in a different sequence, if components in the disclosed systems were combined in a different manner, or if the components were replaced or supplemented by other components. The functions and processes (including algorithms) may be performed in hardware, software, or a combination thereof. Accordingly, other embodiments are contemplated.

What is claimed is:

1. An automated pharmaceutical processing system comprising:

a compounding chamber;

a syringe manipulator station disposed in the compounding chamber, the syringe manipulator station being configured to hold a syringe with a needle directed in a generally downward orientation for drawing fluid through the needle from an IV bag into the held syringe; and a controller comprising a processor to receive instructions that, when executed by the processor, cause the processor to perform operations comprising identifying a type or characteristic associated with the IV bag, wherein the type or characteristic is associated with an IV bag volume capacity or a bag size, identifying a plunger motion profile to create a partial vacuum in the syringe to extract substantially all air from the IV bag without extracting a substantial quantity of fluid from the IV bag, wherein the plunger motion profile is based in part upon the identified type or characteristic of the IV bag and comprises one or more of a plunger acceleration phase, a plunger constant velocity phase, and a plunger deceleration phase, identifying a disengagement motion profile comprising at least one of a disengagement acceleration phase, a disengagement constant velocity phase, and a disengagement deceleration phase, actuating the syringe manipulator station to engage a fill port of the IV bag with the needle of the syringe, actuating the syringe manipulator station to pull the plunger of the syringe according to the plunger motion profile, and actuating the syringe manipulator station to move the fill port and the needle of the syringe out of engagement according to the disengagement motion profile.

2. The system of claim 1, wherein actuating the syringe manipulator station to move the fill port and the needle of the syringe out of engagement begins prior to completion of actuating the syringe manipulator station to pull the plunger of the syringe.

3. The system of claim 1, wherein the plunger motion profile is based on a predetermined pull volume.

4. The system of claim 1, wherein operations further comprise determining a time period to wait between actuating the syringe manipulator station to pull the plunger of the syringe and actuating the syringe manipulator station to move the fill port and the needle of the syringe out of engagement.

5. The system of claim 4, wherein the time period is based in part upon one or more of a cross-sectional area of the needle, a length of the needle and an estimated air volume in the IV bag.

6. The system of claim 1, wherein the disengagement motion profile comprises a first acceleration period which begins substantially upon fluid entry into the syringe.

7. The system of claim 6, wherein the syringe manipulator station further comprises one or more of an optical sensor, an acoustic sensor, an infrared sensor, a laser, and a photographic image monitor for recognizing introduction of fluid into the syringe.

8. The system of claim 6, wherein the operations further comprise detecting a change of torque indicative of completion of air transfer from the IV bag.

9. An automated method for performing a fluid transfer operation, the method comprising:

providing an IV bag at a fluid transfer station;

providing a first syringe at the fluid transfer station;

identifying a first characteristic of the IV bag, wherein the first characteristic is based on one or more of a volume capacity and a bag size;

identifying a predetermined volume of liquid for fluid transfer;

determining a plunger motion profile to create a vacuum in the syringe to extract substantially all air from the IV bag without extracting a substantial quantity of fluid from the IV bag, wherein the plunger motion profile is based in part upon the first characteristic of the IV bag and comprises one or more of a plunger acceleration phase, a plunger constant velocity phase, and a plunger deceleration phase;

determining a disengagement motion profile comprising at least one of a disengagement acceleration phase, a disengagement constant velocity phase, and a disengagement deceleration phase;

inserting a distal tip of a first needle of the first syringe into a fluid transfer port of the IV bag while the first needle of the first syringe is in a generally needle-down orientation and the fluid transfer port is in a generally upward orientation;

actuating a plunger of the first syringe according to the plunger motion profile, extracting the distal tip of the first needle from the fluid transfer port of the IV bag according to the disengagement motion profile;

inserting the distal tip of a second needle of a second syringe into the fluid transfer port of the IV bag; and extracting the predetermined volume of liquid from the IV bag.

10. The method of claim 9, further comprising:

identifying a second characteristic of the IV bag, wherein the second characteristic is based on one or more of the volume capacity, an average fill volume, the bag size, an empty bag weight, and a fluid density;

determining an initial fill volume of the IV bag based in part upon the second characteristic;

determining a withdrawal volume based in part on the initial fill volume;

setting the predetermined volume of liquid to the withdrawal volume prior to extracting the predetermined volume of liquid; and introducing a medicament into the IV bag after extracting the predetermined volume of liquid to produce a desired concentration of the medicament in the IV bag.

11. The method of claim 10, further comprising weighing the IV bag prior to extracting the predetermined volume of liquid to determine a fill weight, wherein the initial fill volume is further based in part upon the fill weight.

12. The method of claim 10, further comprising:

parking the IV bag containing the desired concentration of the medicament at a parking station; and drawing a second predetermined volume of the desired concentration of the medicament to be added to a drug order.

13. The method of claim 9, wherein extracting the predetermined volume of liquid from the IV bag occurs while the needle of the syringe is in the generally needle-down orientation and the fluid transfer port is in the generally upward orientation.

14. The method of claim 9, further comprising:

receiving a user-selectable dwell time, and pausing for the user-selectable dwell time after completion of actuating the plunger of the first syringe according to the plunger motion profile and prior to extracting the distal tip of the first needle from the fluid transfer port of the IV bag according to the disengagement motion profile.

15. The method of claim 9, wherein the first needle and the second needle are the same needle.

* * * * *